US010831126B2

(12) United States Patent
Matsunaga et al.

(10) Patent No.: US 10,831,126 B2
(45) Date of Patent: Nov. 10, 2020

(54) DEVELOPING ROLLER HAVING CROWN-SHAPED ELECTRO-CONDUCTIVE LAYER WITH OUTER SURFACE PROVIDING ELECTRICALLY INSULATING FIRST REGIONS ADJACENT TO SECOND REGIONS HAVING HIGHER CONDUCTIVITY

(71) Applicant: CANON KABUSHIKI KAISHA, Tokyo (JP)

(72) Inventors: Kenta Matsunaga, Susono (JP); Minoru Nakamura, Mishima (JP); Kazuaki Nagaoka, Susono (JP); Ryo Sugiyama, Mishima (JP); Masashi Uno, Mishima (JP); Fumihiko Utsuno, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/545,434

(22) Filed: Aug. 20, 2019

(65) Prior Publication Data

US 2020/0073309 A1 Mar. 5, 2020

(30) Foreign Application Priority Data

Aug. 30, 2018 (JP) ..... 2018-160944

(51) Int. Cl.
*G03G 15/08* (2006.01)
*G03G 21/18* (2006.01)

(52) U.S. Cl.
CPC ..... *G03G 15/0818* (2013.01); *G03G 21/1814* (2013.01); *G03G 2215/00679* (2013.01); *G03G 2215/2058* (2013.01)

(58) Field of Classification Search
CPC ..... G03G 15/0818
See application file for complete search history.

(56) References Cited

U.S. PATENT DOCUMENTS 7,727,134 B2 6/2010 Nakamura et al.
7,797,833 B2 9/2010 Nakamura et al.
(Continued)

FOREIGN PATENT DOCUMENTS

EP 2 787 394 10/2014
JP S62-55147 3/1987
(Continued)

OTHER PUBLICATIONS

U.S. Appl. No. 16/516,790, Kazutoshi Ishida, filed Jul. 19, 2019.
(Continued)

*Primary Examiner* — Arlene Heredia
(74) *Attorney, Agent, or Firm* — Venable LLP

(57) ABSTRACT

A developing roller is capable of preventing the generation of a difference in image density between a central portion and an end portion of an electrographic image. The developing roller has an electro-conductive mandrel and an electro-conductive layer on the mandrel, the electro-conductive layer has a crown shape in which an outer diameter of a central portion in a direction along the mandrel is larger than outer diameters of both end portions in the direction along the mandrel, an outer surface of the developing roller includes a first region having an electrically insulating property and a second region having a higher conductive property than the first region, and the first region and the second region are disposed adjacent to each other.

12 Claims, 5 Drawing Sheets

(56) References Cited

U.S. PATENT DOCUMENTS

| | | | | |
|---|---|---|---|---|
| 7,798,948 | B2 | 9/2010 | Kawamura et al. | |
| 7,799,398 | B2 | 9/2010 | Nakamura et al. | |
| 8,655,222 | B2 | 2/2014 | Nakamura et al. | |
| 8,655,238 | B2 | 2/2014 | Uno et al. | |
| 8,745,870 | B2 | 6/2014 | Kawamura et al. | |
| 8,768,227 | B2 | 7/2014 | Urushihara et al. | |
| 8,798,508 | B2 | 8/2014 | Yamada et al. | |
| 8,874,007 | B2 | 8/2014 | Kawamura et al. | |
| 8,934,821 | B2 * | 1/2015 | Kubo | G03G 15/162 399/302 |
| 9,213,258 | B2 * | 12/2015 | Goto | G03G 15/0812 |
| 9,256,156 | B2 * | 2/2016 | Goto | G03G 15/081 |
| 9,482,986 | B2 * | 11/2016 | Sakurai | G03G 15/0808 |
| 9,625,854 | B2 | 4/2017 | Koyanagi et al. | |
| 9,846,407 | B2 | 12/2017 | Nakamura et al. | |
| 9,921,518 | B2 | 3/2018 | Sakurai et al. | |
| 9,952,531 | B2 | 4/2018 | Ishii et al. | |
| 9,952,532 | B2 | 4/2018 | Sugiyama et al. | |
| 10,303,079 | B2 | 5/2019 | Utsuno et al. | |
| 10,310,447 | B2 | 6/2019 | Morishita et al. | |
| 2013/0164038 | A1 | 6/2013 | Kusaba et al. | |
| 2013/0266339 | A1 | 10/2013 | Sugiyama et al. | |
| 2014/0301754 | A1 | 10/2014 | Uematsu et al. | |
| 2015/0055989 | A1 | 2/2015 | Goto et al. | |
| 2017/0097580 | A1 * | 4/2017 | Ishida | G03G 15/0818 |
| 2017/0139336 | A1 | 5/2017 | Nagaoka et al. | |
| 2017/0248867 | A1 | 8/2017 | Sakurai et al. | |
| 2019/0094741 | A1 | 5/2019 | Uno et al. | |
| 2019/0265609 | A1 | 8/2019 | Sakurai et al. | |
| 2019/0324382 | A1 | 10/2019 | Sugiyama et al. | |

FOREIGN PATENT DOCUMENTS

| | | |
|---|---|---|
| JP | H04-336561 | 11/1992 |
| JP | H10-196637 | 7/1998 |
| JP | 2001-350351 | 12/2001 |
| JP | 2005-352084 | 12/2005 |
| JP | 2007-264129 | 10/2007 |
| JP | 2014-211624 | 11/2014 |

OTHER PUBLICATIONS

U.S. Appl. No. 16/524,794, Shohei Urushihara, filed Jul. 29, 2019.
U.S. Appl. No. 16/525,693, Seiji Tsuru, filed Jul. 30, 2019.
U.S. Appl. No. 16/526,125, Sosuke Yamaguchi, filed Jul. 30, 2019.
U.S. Appl. No. 16/540,463, Noriyuki Doi, filed Aug. 14, 2019.
U.S. Appl. No. 16/541,732, Kazuhito Wakabayashi, filed Aug. 15, 2019.
U.S. Appl. No. 16/569,768, Fumihiko Utsono, filed Sep. 13, 2019.
U.S. Appl. No. 16/672,770, Wataru Moriai, filed Nov. 4, 2019.
U.S. Appl. No. 16/695,754, Kazutoshi Ishida, filed Nov. 26, 2019.

* cited by examiner

DEVELOPING ROLLER HAVING CROWN-SHAPED ELECTRO-CONDUCTIVE LAYER WITH OUTER SURFACE PROVIDING ELECTRICALLY INSULATING FIRST REGIONS ADJACENT TO SECOND REGIONS HAVING HIGHER CONDUCTIVITY

BACKGROUND

The present disclosure relates to a developing roller, a process cartridge, and an electrophotographic image forming apparatus.

DESCRIPTION OF THE RELATED ART

A developing roller that is used in an electrophotographic image forming apparatus has, for example, an electro-conductive layer formed on the circumference of a mandrel. In addition, the above-described conductive layer in the developing roller is held in contact by a predetermined pressure with a certain member having a roller shape such as a photoconductive drum or a developer feeding roller in the electrophotographic image forming apparatus.

At this time, in order to even the width of the developing roller in the circumferential direction in a nip formed by the developing roller and the certain member in a direction along the shaft of the developing roller (hereinafter, also referred to as "direction along the mandrel"), a layer in the developing roller that is held in contact with the certain member is formed in a crown shape as a contour shape (refer to Japanese Patent Application Laid-Open No. 2007-264129). The crown shape refers to a shape in which the outer diameter of a central portion of the developing roller in the direction along the mandrel (hereinafter, also referred to as "central portion") is larger than the outer diameter of an end portion of the developing roller in the direction along the mandrel (hereinafter, referred to as "end portion").

The present inventors found that, when, for example, a solid black electrophotographic image is formed using an electrophotographic image forming apparatus equipped with a contact development device in which a developing roller having a crown shape is used, there is a case where a difference in the image density is caused between a central portion and an end portion of the electrophotographic image in a direction orthogonal to a transportation direction in the electrophotographic image forming apparatus.

According to the present inventors' studies, it was recognized that the above-described difference in the image density is attributed to the crown shape of the developing roller. That is, it was recognized that, in a step of forming an electrophotographic image, a developer carried by the surface of the developing roller gradually migrates to be eccentrically located in the end portion of the developing roller along the crown shape, and, consequently, the difference in image density is caused.

SUMMARY

One aspect of the present disclosure is directed to providing a developing roller capable of preventing the generation of a difference in image density between a central portion and an end portion of an electrophotographic image. Another aspect of the present disclosure is directed to providing an electrophotographic image forming apparatus capable of stably outputting high-quality electrophotographic images. Still another aspect of the present disclosure is directed to providing a process cartridge contributing to the stable formation of high-quality electrographic images.

According to the aspect of the present disclosure, there is provided a developing roller having an electro-conductive mandrel and an electro-conductive layer on the mandrel, in which the electro-conductive layer has a crown shape in which an outer diameter of a central portion in a direction along the mandrel is larger than outer diameters of both end portions in the direction along the mandrel, an outer surface of the developing roller includes electrically insulating first regions and a second region whose electro-conductivity is higher than that of the first regions, and each of the first regions is adjacent to the second region.

In addition, according to the another aspect of the present disclosure, there is provided a process cartridge which is configured to be attachable to and detachable from a main body of an electrophotographic image forming apparatus and is equipped with at least a developing roller and in which the developing roller is the above-described developing roller.

Furthermore, according to the still another aspect of the present disclosure, there is provided an electrophotographic image forming apparatus equipped with a developing roller, in which the developing roller is the above-described developing roller.

Further features of the present invention will become apparent from the following description of exemplary embodiments with reference to the attached drawings.

DESCRIPTION OF THE EMBODIMENTS

Figure 1B:
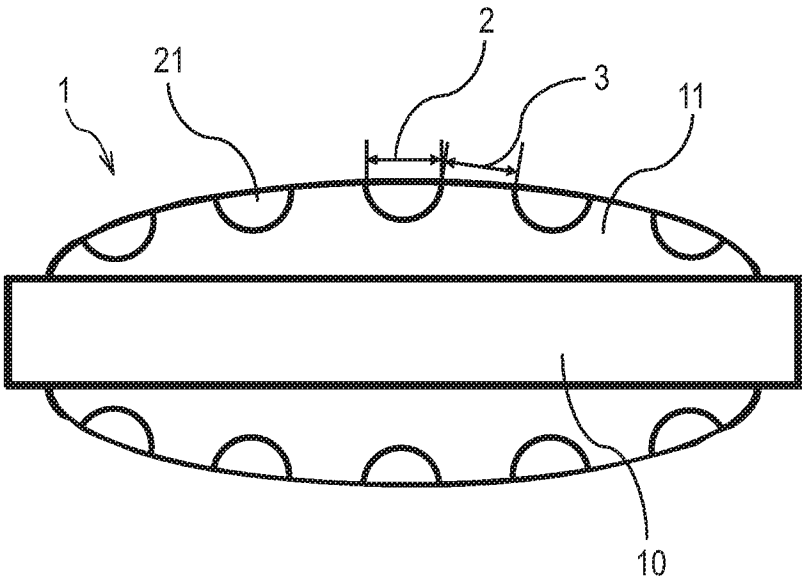
FIGS. 1A, 1B and 1C are schematic configuration views of a developing roller according to an embodiment of the present disclosure.

A developing roller according to an aspect of the present disclosure has an electro-conductive mandrel and an electro-conductive layer on the mandrel. Furthermore, the electro-conductive layer has a crown shape in which the outer diameter of a central portion in a direction along the mandrel is larger than the outer diameters of both end portions in the direction along the mandrel. In addition, an outer surface of the developing roller includes electrically insulating first regions and a second region whose electro-conductivity is higher than the electro-conductivity of the first regions. Further, each of the first regions is adjacent to the second region.

The outer surface of the developing roller may be configured, for example, so that the first region is present in a domain shape in a matrix of the second region or so that the second region is present as a domain in a matrix of the first region.

According to the present inventors' studies, the maldistribution of a developer toward the end portion sides of the developing roller, which is attributed to the crown shape, is likely to occur when the developer is pressed toward the developing roller having a crown shape such as during the feeding of the developer or during the regulation of the amount of the developer using a developer regulating member. The above-described maldistribution of the developer toward the end portion sides of the developing roller is considered to be attributed to the flow of the developer caused from the central portion toward the end portions along the crown shape, that is, the slope of a shape having a slope in which the outer diameter decreases from the central portion toward the end portions in a direction along the mandrel when the developer is pressed toward the developing roller.

Therefore, the present inventors repeated studies for the purpose of obtaining a developing roller which has a crown shape, but is capable of suppressing the maldistribution of a developer in end portions of the developing roller in spite of long-term use. As a result, it was found that the developing roller according to the present disclosure is capable of well achieving the purpose. The present inventors assume that the reason therefor is a gradient force acting between the first region and the second region that form part of the outer surface of the developing roller according to the present aspect.

The gradient force refers to a force affecting an article present in an electric field gradient that is caused between regions having a potential difference. The presence of an article in an electric field gradient causes a gradient (difference in intensity) in polarization in the article which is generated according to the electric field intensity. As a result, a force causing the article to face a direction in which polarization increases, that is, a direction in which the electric field becomes stronger is generated, which is the gradient force. An electric field gradient generating the gradient force can be generated by causing surfaces having a potential difference, for example, the same planar surface provided with regions having a potential difference to be present in a positional relationship in which the surfaces do not face each other.

In the developing roller according to the present disclosure, the outer surface of the developing roller includes the electrically-insulating first regions and the second region having a higher electro-conductivity than that of the first regions. Each of the first regions is adjacent to the second region. In a case where the above-described developing roller is used to form an electrophotographic image, the outer surface of the developing roller is subjected to friction by a developer, and thus the first region is charged. As a result, a potential difference is generated between each of the first regions and the second region that is more highly conductive relative to the first region and is not easily charged. Therefore, in the developing roller according to the present disclosure, an electric field gradient that prevents surfaces having a potential difference from facing each other is generated, and a gradient force is generated in a direction in which the developer is attracted near the first regions of the development roller. As a result, it is considered that the flow of the developer from the central portion toward the end portions of the developing roller along the crown shape of the developing roller is suppressed and the maldistribution of the developer in the end portions of the developing roller is suppressed.

In addition, in the developing roller according to the present disclosure, when a developer is pressed toward the developing roller, a force causing the developer to flow from the central portion toward the end portions of the developing roller along the slope derived from the crown shape acts on the developer. Such a force serves as a cause for generating the maldistribution of the developer in the end portions of the developing roller. However, in the developing roller according to the present disclosure, in a case where the first regions form protrusions in an outer surface of the developing roller, the presence of such a force enables the collision of a larger amount of the developer with a surface of the developing roller on the central portion side in the direction along the mandrel in the first region.

Figure 4A:
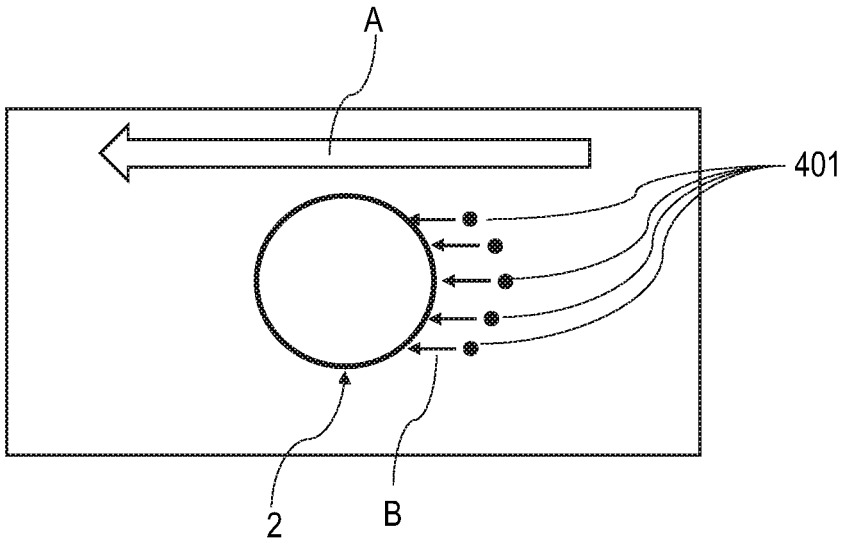
FIG. 4A and FIG. 4B are views for describing behaviors of a developer present on a circumference of a first region on an outer surface of the developing roller according to the embodiment of the present disclosure.
Figure 4B:
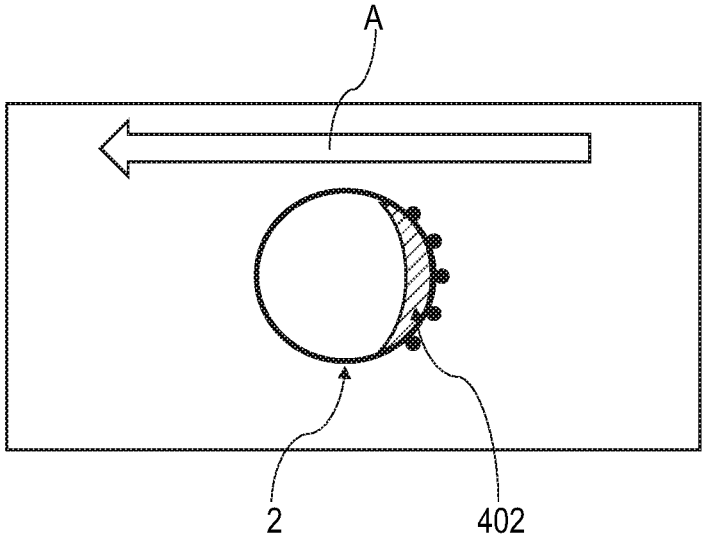

FIG. 4A and FIG. 4B are plan views for describing the behaviors of a developer 401 present on the circumference of the first region 2 on the outer surface of the developing roller according to the present disclosure.

In FIG. 4A and FIG. 4B, an arrow A indicates a direction from the central portion toward the end portion of the developing roller in the direction along the mandrel. In addition, the developer 401 on the surface of the developing roller receives the above-described force, moves in a direction of an arrow B, and comes into contact with the first region 2, and charges that the developer has are delivered to the region 402. As a result, in a region 402 on the central portion side in the direction along the mandrel of the developing roller in the first region, a larger number of charges are accumulated, which enlarges the potential difference between the first region and the second region on the circumference of the first region. As a result, it is considered that the gradient force that acts on the region 402 also intensifies, a capability of holding the developer near the region 402 also enhances, and it is possible to more reliably suppress the flow of the developer from the central portion toward the end portions of the developing roller in the direction along the mandrel.

Hereinafter, the developing roller according to the present aspect will be described in detail.

<Developing Roller>

Figure 1A:
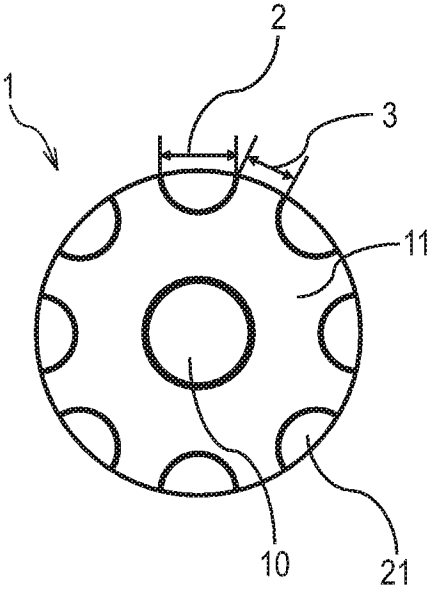
Figure 1C:
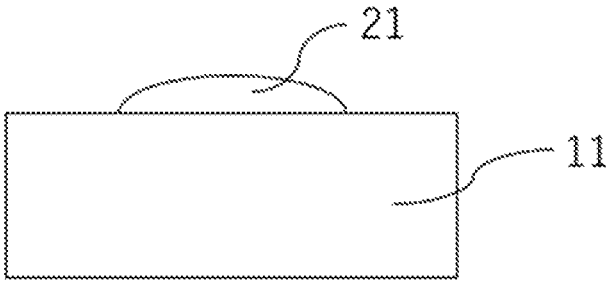

An example of the developing roller according to the present aspect is illustrated in FIG. 1A and FIG. 1B. FIG. 1A is a cross-sectional view of a developing roller 1 according to the present aspect in a direction orthogonal to a mandrel 10. FIG. 1B is a cross-sectional view of the developing roller 1 in a direction along the mandrel 10.

The developing roller 1 has the electro-conductive mandrel 10 and an electro-conductive layer 11 covering the circumference of the mandrel. The electro-conductive layer 11 has a crown shape in which the outer diameter of a central portion in a direction along the mandrel 10 is larger than the outer diameters of both end portions. In addition, an outer surface of the developing roller 1 includes electrically insulating first regions 2 and second regions 3 having a higher electro-conductivity than that of the first regions, and each of the first regions 2 is adjacent to the second region 3.

The presence of the first regions and the second region can be confirmed by charging the outer surface of the developing roller and then measuring the residual potential distribution. The residual potential distribution can be confirmed by, for example, sufficiently charging the outer surface of the developing roller using a charging apparatus such as a corona discharging apparatus and then measuring the residual potential distribution on the charged outer surface of the developing roller using an electrostatic force microscope (EFM), a Kevin force microscope (KFM), or the like.

[First Region]

The first region constitutes a part of the outer surface of the developing roller. The area of one first region is preferably 3 $\mu m^2$ or larger and 100,000 $\mu m^2$ or smaller. When the area is in the above-described range, it is possible to more reliably hold the developer near one first region.

The surface of each of the first regions may be flush with the outer surface of the electro-conductive layer 11 as illustrated in FIG. 1A and FIG. 1B. The surface of each of the first regions may constitute a projection in the outer surface of the developing roller, or may form a hollow in a recess shape in the outer surface of the developing roller.

The developing roller as shown in FIG. 1A and FIG. 1B, the first regions 2 are constituted by insulating portions. A part of each of the insulating portions are buried in the electro-conductive layer 11, and a part of each of the insulating portions are exposed to the outer surface of the developing roller. However, the developing roller according to the present disclosure is not limited to that shown in FIG. 1A and FIG. 1B. For example, a developing roller whose first regions are constituted by insulating portions not buried in the electro-conductive layer 11 but disposed on an outer surface of the electro-conductive layer 11, is also one aspect of the developing roller according to the present disclosure. Whether the first regions form protrusions or recesses depends on the relationship between a material that forms the first region and a material of the electro-conductive layer (a difference in the amounts of the materials polished) or a method for forming the first region. A method for producing a developing roller having first regions with a protrusion shape will be described below.

In a case where the first regions constitute projections in the outer surface of the developing roller, the accumulation of charges in the region 402 attributed to the collision with the developer in the central portion side of the first region in the direction along the mandrel of the developing roller, which has been described using FIG. 4A and FIG. 4B, is accelerated. Therefore, the maldistribution of the developer in the end portions in the direction along the mandrel can be further improved.

The first regions form part of the outer surface of the developing roller. Therefore, an electrically insulating substance that is not exposed on the outer surface of the developing roller, for example, electrically insulating particles that are included in the electro-conductive layer is differentiated from the first region according to the present disclosure.

The electrically insulating property of the first region can be quantified using the potential decay time constant. The potential decay time constant is defined as a period of time necessary for the potential of the surface of the first region having an electrically insulating property which forms the outer surface of the developing roller to decay to $V_0 \times (1/e)$ (V) when the surface of each of the first regions is charged to $V_0$ (V) and the potential decay time constant serves as an index for the easiness of holding a charged potential. Here, e represents the base of natural logarithm.

In addition, the potential decay time constant of each of the first regions is preferably 60.0 seconds or longer. When the potential decay time constant of the first region is 60.0 seconds or longer, charges are more easily accumulated in the first region, and it is possible to further increase the potential difference with the second region described below. As a result, it is possible to further increase the gradient force for fastening the developer near the first region. The potential decay time constant can be obtained by, for example, sufficiently charging the outer surface of the developing roller using a charging apparatus such as a corona discharging apparatus and then measuring the temporal transition of the residual potential in the first region on the charged outer surface of the developing roller using an electrostatic force microscope (EFM). The detail of a method for measuring the potential decay time constant will be described below in detail.

In addition, assuming that a 300 μm×300 μm square region is put on the outer surface of the developing roller so that one side of the square region is parallel to the direction along the mandrel of the developing roller, the proportion of the total area of the first regions in the area (90,000 $\mu m^2$) of the square region (hereinafter, referred to as "coating rate") is preferably 10% or more to 60% or less. When the coating rate is in the above-described range, the electro-conductive property of the electro-conductive layer is not impaired, and the contact between the first regions and the developer becomes easy.

Furthermore, when an arithmetic average of the thicknesses of electrically insulating portions that form the first regions, which can be obtained using a calculation method described below, is represented by D (μm), the coefficient of variation C of D is preferably lower than 0.5. Here, C is represented by σ/D, and σ represents the standard deviation of the distribution of the thicknesses of the electrically insulating portions.

<Method for Calculating Arithmetic Average D>

A 900 μm×900 μm square region A is placed at a position that is in a direction along the mandrel of the developing roller so that one side of the square region A is parallel to the direction along the mandrel of the developing roller.

A 900 μm×900 μm square region B is placed at a position 120 degrees rotated from the position, at which the square region A is placed, in the circumferential direction of the developing roller so that one side of the square region B is parallel to the direction along the mandrel of the developing roller. Furthermore, a 900 μm×900 square region C is placed at a position further 120 degrees rotated from the position, at which the square region B is placed, in the circumferential direction of the developing roller so that one side of the square region C is parallel to the direction along the mandrel of the developing roller.

In addition, for each of the electrically insulating portions forming the first regions that are fully included in each region of the square regions A to C, the maximum value of thickness is measured. The arithmetic average of the respective maximum values of thickness of the electrically insulating portions is represented by D (μm).

That is, the gradient force has a positive correlation with the thicknesses of the electrically insulating portions that form the first regions. In addition, when the coefficient of variation C of the arithmetic average D of the maximum thicknesses of the electrically insulating portions that are fully included in the square regions A to C, which are at the same position in the direction along the shaft of the developing roller, is set to be lower than 0.5, it is possible to even the gradient forces that act on a plurality of the electrically insulating portions each present in the circumferential direction at a predetermined position in the direction along the shaft of the developing roller. That is, the capability of holding the developer in the electrically insulating portions at the predetermined position in the direction along the shaft of the developing roller is further evened in the circumferential direction of the developing roller. As a result, an effect for suppressing the migration of the developer from the central portion toward the end portions in the direction along the shaft of the developing roller, which is attributed to the crown shape, can be evened in the circumferential direction of the developing roller.

As a method for configuring the above-described electrically insulating portion having a coefficient of variation C of lower than 0.5, methods as described below are exemplified. A method in which the electro-conductive layer is provided with a multilayer structure, and the electrically insulating portion compounded into the outermost layer is polished and exposed, thereby regulating the thickness of the electrically insulating portion with the film thickness of the outermost layer. A method in which electrically insulating portions having an even thickness are disposed on the electro-conductive layer using a variety of printing units.

When an arithmetic average of thicknesses of the electrically insulating portions in a circumferential direction which are positioned in central part in the direction along the mandrel is defined as D1, and an arithmetic average of thicknesses of the electrically insulating portions in a circumferential direction which are positioned in at least one of end parts in the direction along the mandrel is defined as D2, D1 is preferably smaller than D2. In a phenomenon of the maldistribution of the developer in the end portion, a developer maldistribution force arising from the extrusion of the developer becomes stronger toward the end portion. That is, in order to use the developing roller having a crown shape without any maldistribution of the developer, the gradient force in the end portion is preferably stronger than the gradient force in the central portion. When the arithmetic average D2 is set to be larger than the arithmetic average D1, the gradient force having a positive correlation with respect to the thickness becomes strong in the end portion of the developing roller. Therefore, it becomes easy to hold the developer using the gradient force in the electrically insulating portions on the central portion side, and it is possible to suppress the maldistribution of the developer which becomes strong in the end portion of the developing roller. A method for measuring D1 and D2 will be described below.

As a method for configuring the electrically insulating portion in which D1 is smaller than D2, methods as described below are exemplified. A method in which the electro-conductive layer is provided with a multilayer structure, the outermost layer is dipped in a direction along the mandrel direction at the time of being formed by dipping, and the film thickness at the end part is set to be larger than the film thickness at the central part by changing the lifting speed, thereby controlling the thickness of the electrically insulating portion compounded into the outermost layer with the film thickness of the outermost layer. A method in which the electro-conductive layer is provided with a multilayer structure, and the amount of the outermost layer polished gradually decreases from the central part toward the end part, thereby controlling the thickness of the polished and exposed electrically insulating portion. A method in which the thickness of the electrically insulating portion gradually increases toward the end part using a variety of printing units.

When the proportion of the area of the first regions in at least one end part of the developing roller is larger than the proportion of the area of the first regions in the central part of the developing roller, it is possible to increase the gradient force in accordance with the slope of the crown shape against the phenomenon of the maldistribution of the developer in the end portion, which is preferable. In the phenomenon of the maldistribution of the developer in the end part, the developer maldistribution force arising from the extrusion of the developer becomes stronger toward the end part. Therefore, in order to use the developing roller having a crown shape without any maldistribution of the developer, the effect for suppressing the maldistribution of the developer in the end part is preferably stronger than that in the central part. That is, when the proportion of the area of the first regions in the end part is set to be larger than that in the central part, it is possible to enlarge the first regions capable of suppressing the maldistribution of the developer toward the end portion. Therefore, it becomes easy to hold the developer using the gradient force in the central portion of the electrically insulating portion against the maldistribution of the developer which becomes stronger in the end part of the developing roller, and the maldistribution of the developer is reduced.

As a material of the electrically insulating portion, resins and metal oxides can be exemplified. Among these, resins that can be more easily charged are preferred. Specific examples of the resins will be described below. Acrylic resins, polyolefin resins, epoxy resins, and polyester resins. Among these, polyester resins are preferred since the polyester resins are capable of easily adjusting the potential decay time constant of the electrically insulating portion.

As the polyester resins, specifically, for example, polymers and copolymers for which the following monomers are used as a raw material are exemplified. Methyl methacrylate, 4-tert-butylcyclohexanol acrylate, stearyl acrylate, lauryl acrylate, 2-phenoxyethyl acrylate, isodecyl acrylate, isooctyl acrylate, isobornyl acrylate, 4-ethoxylated nonyl phenol acrylate, ethoxylated bisphenol A diacrylate. These polyester resins may be used singly or two or more polyester resins may be jointly used.

(Protrusion)

The first region may have a protrusion on the outer surface of the developing roller. The protrusion refers to the first region that has an electrically insulating portion projecting from the outer surface of the electro-conductive layer and forms the outer surface of the developing roller. According to a method for forming the electrically insulating portion by applying a coating liquid including the material of the electrically insulating portion onto the outer surface of the electro-conductive layer or a method for forming the electrically insulating portion by attaching the coating liquid to the outer surface of the electro-conductive layer using an ink jet method among methods for forming the electrically insulating portion described below, it is possible to obtain a developing roller in which the first regions have protrusions on the outer surface of the developing roller.

When the first regions have protrusions on the outer surface of the developing roller, the contact opportunity between the central portion side of the first region and the developer increases, which is preferable. As described above, in the present disclosure, it is possible to hold the maldistribution of the developer in the end portions on the central portion side of the first region. In order to hold the maldistribution of the developer in the end portions on the central portion side of the first region, it is necessary to rapidly charge such an electrically insulating portion. At this time, when the electrically insulating portion that forms the first region has the protrusion, it is possible to increase the frequencies of both the holding of the developer and the imparting of charges from the developer on the central portion side of the first region due to the shape. Therefore, the electrically insulating portion can be rapidly charged, and it is possible to rapidly obtain a synergistic effect made up of the gradient force and the maldistribution of the developer in the end portions.

[Second Region]

The second region is formed of an exposed portion of the outer surface of the electro-conductive layer, that is, the outer surface not coated with the first region and has a higher conductive property than the first region. The electro-conductive property of the second region can also be quantified using the potential decay time constant. That is, the potential decay time constant of the second region, which is defined as a period of time necessary for the potential of the surface of the second region that forms the outer surface of the developing roller to decay to $V_0 \times (1/e)$ (V) when the potential of the surface of the second region is charged to reach $V_0$ (V) is preferably shorter than 6.0 seconds.

When the potential decay time constant of the second region is shorter than 6.0 seconds, the charging of the electro-conductive layer is suppressed, a potential difference is likely to be caused between the charged electrically insulating portion and the second region, and it is easy to develop the gradient force. In the measurement of the potential decay time constant, in a case where the residual potential reaches approximately 0 V at the time of beginning the measurement in the following measurement method, that is, a case where the potential fully decays at the time of beginning the measurement, the potential decay time constant at the measurement point is regarded as shorter than 6.0 seconds.

The potential decay time constant of the second region can be obtained by, for example, sufficiently charging the outer surface of the developing roller including the second region using a charging apparatus such as a corona discharging apparatus and then measuring the temporal transition of the residual potential in the charged second region using an electrostatic force microscope (EFM).

[Conductive Layer]

The electro-conductive layer is a single layer or a multilayer made up of two or more layers formed on the mandrel and has a crown shape as the contour shape.

(Crown Shape)

The electro-conductive layer has a crown shape. The crown shape according to the present aspect refers to a shape in which the outer diameter gradually decreases at a certain curvature from the central portion toward the end portions in the mandrel direction. The difference between the outer diameter of the central portion of the electro-conductive layer and the outer diameters of both end portions is regarded as a crown amount. The crown amount is preferably 25 μm or larger and 500 μm or smaller. When the crown amount is in the above-described range, it becomes easy to obtain an even contact width in spite of the above-described curve at the time of bringing the developing roller into contact with a certain member. In a case where the electro-conductive layer has a multilayer structure, the crown amount of the entire conductive layer needs to be in the above-described range. The crown shape can be formed using, for example, a traverse grinding method in which the electro-conductive layer is ground by moving a grinding stone or the developing roller in the direction along the mandrel or a plunge cut grinding method in which an abrasive wheel that is wider than the length of the developing roller is caused to cut into the electro-conductive layer without being reciprocated while the roller is rotated using the mandrel. Between these, the plunge cut grinding method has an advantage of being capable of grinding the entire width of the electro-conductive layer at once and shortens the process time and is thus suitable for continuous production, which is preferable.

The electro-conductive layer that forms the second region includes a binder resin and an electro-conductive property-imparting agent and further includes other additives as necessary.

As the binder resin, for example, a polyurethane resin, a polyamide, a urea resin, a polyimide, a fluorine resin, a phenol resin, an alkyd resin, a silicone resin, a polyester, an ethylene-propylene-diene copolymer rubber (EPDM), an epichlorohydrin homopolymer (CHC), an epichlorohydrin-ethylene oxide copolymer (CHR), an epichlorohydrin-ethylene oxide-allyl glycidyl ether terpolymer (CHR-AGE), acrylonitrile-butadiene rubber (NBR), chloroprene rubber (CR), natural rubber (NR), isoprene rubber (IR), styrene-butadiene rubber (SBR), fluoro rubber, silicone rubber, a hydride of NBR (H-NBR), and the like are exemplified. These binder resins may be used singly or two or more binder resins may be jointly used.

For the electro-conductive layer, it is possible to blend an electro-conductive property-imparting agent such as an electron-conducting substance or an ion-conducting substance into the binder resin in order to adjust the potential decay time constant. As the electron-conducting substance, for example, the following substances are exemplified. Conductive carbon, for example, carbon black such as ketjen black EC and acetylene black; carbon for rubber such as super abrasion furnace (SAF), intermediate SAF (ISAF), high abrasion furnace (HAF), fast extruding furnace (FEF), general purpose furnace (GPF), semi-reinforcing furnace (SRF), fine thermal (FT), and medium thermal (MT); carbon for oxidation-treated color (ink); metal such as copper, silver, and germanium and metal oxides thereof. Among these, conductive carbon with which the electro-conductive property is easily controlled in a small amount is preferred. As the ion-conducting substance, for example, the following substances are exemplified. Inorganic ion-conducting substances such as sodium perchlorate, lithium perchlorate, calcium perchlorate, and lithium chloride; organic ion-conducting substances such as modified aliphatic dimethyl ammonium ethosulfate and stearyl ammonium acetate.

To the electro-conductive layer, it is possible to further add a variety of additives such as particles, an electro-conductive agent, a plasticizer, a filler, an extender, a vulcanizing agent, a vulcanization aid, a crosslinking aid, a curing inhibitor, an antioxidant, an antiaging agent, and a process aid as necessary.

The electro-conductive layer may have a monolayer structure or may have a multilayer structure. In a case where the electro-conductive layer has a multilayer structure, as described above, when the arithmetic average in the circumferential direction of the thicknesses of the electrically insulating portions is represented by D (μm), it is easy to set the coefficient of variation C of D to lower than 0.5, which is preferable. In addition, in a case where the electro-conductive layer has a multilayer structure, the surface of the electro-conductive layer in the lower layer may be reformed in order to improve the adhesiveness. The reforming is carried out by, for example, surface polishing, a corona treatment, a flame treatment, an excimer treatment, or the like.

[Mandrel]

The mandrel has an electro-conductive property and has a function of supporting the electro-conductive layer that is provided on the mandrel. As a material of the mandrel, for example, metals such as iron, copper, aluminum, and nickel; stainless steels including these metals, alloys such as duralumin, brass, and bronze can be exemplified. These materials may be used singly or two or more materials may be jointly used. A plating treatment can be carried out on the surface of the mandrel for the purpose of imparting damage resistance as long as the electro-conductive property is not impaired. Furthermore, a mandrel produced by coating the surface of a resin mandrel with metal to impart an electro-conductive property or a mandrel manufactured using an electro-conductive resin composition are also available.

[Method for Manufacturing Developing Roller]

Here, an example of a method for manufacturing the developing roller having a crown shape using the plunge cut grinding method will be described. The developing roller according to the present aspect can be manufactured using, for example, a manufacturing method having the following steps 1 and 2.

Step 1: A step of forming the electro-conductive layer made of an electro-conductive resin portion and the electrically insulating portion on the mandrel Step 2: A step of forming the crown shape by grinding the electro-conductive layer (Step 1)

The electro-conductive layer and the electrically insulating portions are formed on the mandrel. Hereinafter, a specific example will be described. First, a mixture of the binder resin, the electro-conductive property-imparting agent, a variety of additives, which configure the electro-conductive layer, and the material of the electrically insulating portion is prepared. Subsequently, the circumferential surface of the mandrel is molded in a roller shape using the mixture. In the case of using unvulcanized thermosetting rubber as the binder resin, a vulcanization (crosslinking) operation or the like is carried out after molding, which stabilizes the binder resin.

As a method for molding the circumferential surface of the mandrel in a roller shape, the following methods (a) to (c) can be exemplified.

(a) A method in which the mixture is extrusion-molded in a tube shape using an extruder and a cored bar is inserted thereinto;

(b) A method in which the mixture is coextruded in a cylindrical shape around a cored bar using an extruder equipped with a crosshead and a compact having a desired outer diameter is obtained; and (c) A method in which the mixture is poured into a mold having a desired outer diameter using an injection-molding machine, thereby obtaining a compact.

The mixture is vulcanized by a heating treatment. As specific examples of a method of the heating treatment, hot-air oven heating using a gear oven, heating vulcanization using far infrared rays, steam heating using a vulcanizer, and the like can be exemplified.

(Step 2)

The surface of the compact obtained by the step 1 is ground using the plunger cut grinding method, thereby obtaining a desired crown shape. In the case of forming an electro-conductive layer having a multilayer structure, such an electro-conductive layer can be formed using, for example, the following method after the step 1. A coating liquid including a material that configures the electro-conductive resin portion is prepared. The compact obtained in the step 1 is dipped in the coating liquid and dried, thereby forming a laminate structure.

Subsequently, the electrically insulating portions that serve as the first regions are formed. As a method for forming the electrically insulating portions, a method in which the material of the electrically insulating portion and a material of the electro-conductive resin portion are mixed together and phases are separated under an appropriate condition, thereby forming the electrically insulating portions, a method in which insulating particles are blended into the mixture in the step 1 or the coating liquid, polished, and exposed, a method in which the electrically insulating portions are formed by applying (spraying, dipping, or the like) a coating liquid including the material of the electrically insulating portion, a method in which the material of the electrically insulating portion is printed using a variety of printing method, and the like are exemplified. Among these, the method in which the material of the electrically insulating portion is printed using an ink jet method that is one of printing methods is capable of easily pattern-printing the electrically insulating portions on the previously-formed conductive layer, which is preferable.

<Process Cartridge and Electrophotographic Image Forming Apparatus>

Figure 2:
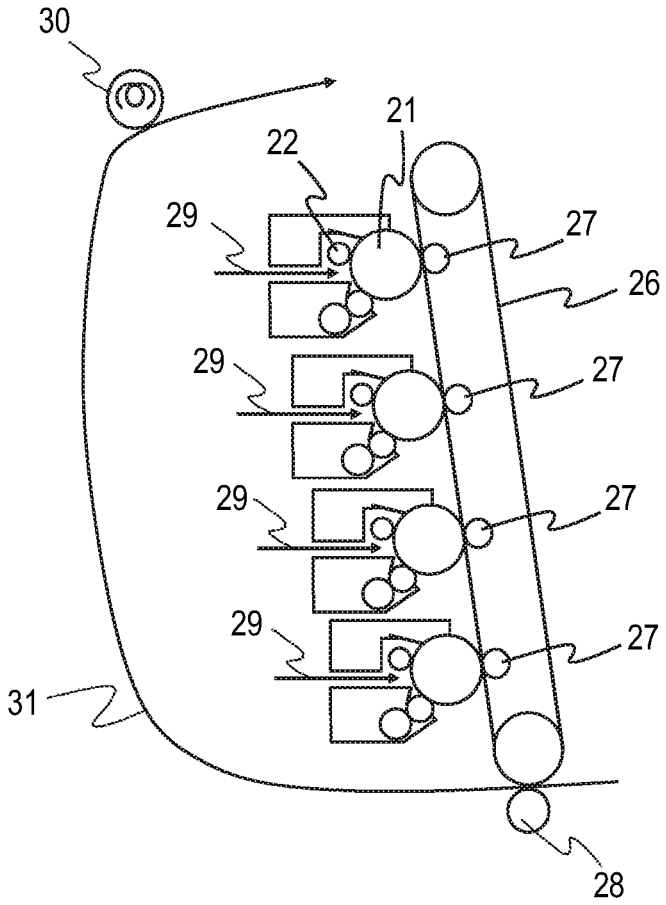
FIG. 2 is a schematic configuration view of an electrophotographic image forming apparatus according to an embodiment of the present disclosure.

A process cartridge according to the present aspect is equipped with at least development unit, and the development unit has the developing roller according to the present aspect. In addition, an electrophotographic image forming apparatus according to the present aspect is equipped with a development unit, and the development unit has the developing roller according to the present aspect. FIG. 2 illustrates a scheme of an example of the electrophotographic image forming apparatus according to the present aspect. In addition, a scheme of an example of the process cartridge according to the present aspect that is mounted in the electrophotographic image forming apparatus of FIG. 2 is illustrated in FIG. 3.

Figure 3:
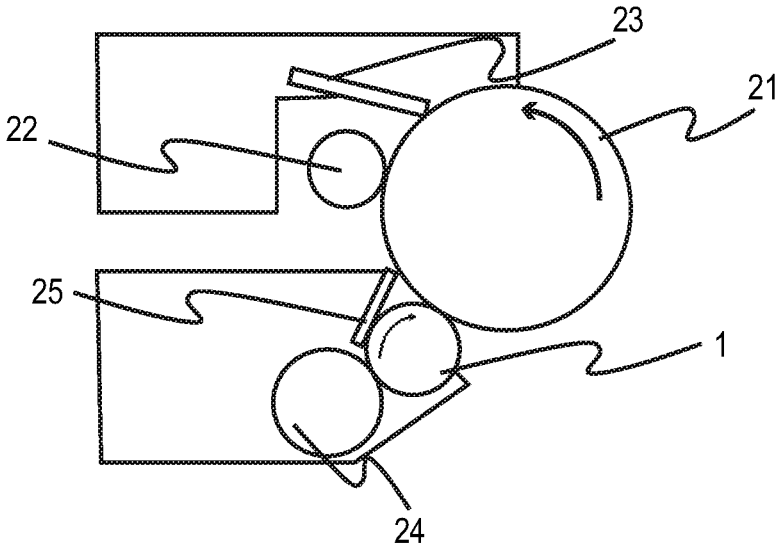
FIG. 3 is a schematic configuration view of a process cartridge according to an embodiment of the present disclosure.

The process cartridge illustrated in FIG. 3 has a photoconductive drum 21, a charging roller 22, a developing roller 1, a cleaning member 23, a toner feeding roller 24, and a toner regulating member 25. In addition, the process cartridge is configured so as to be attachable to and detachable from a main body of the electrophotographic image forming apparatus illustrated in FIG. 2.

The photoconductive drum 21 is uniformly charged (primary charging) by the charging roller 22 connected to a bias power supply not illustrated. Next, exposure light 29 for writing electrostatic latent images is radiated to the photoconductive drum 21 from a stepper not illustrated, and an electrostatic latent image is formed on the surface of the photoconductive drum. As the exposure light, any of LED light and laser light can be used.

Next, a toner negatively charged by the developing roller 1 is imparted to the electrostatic latent image, a toner image is formed on the photoconductive drum, and the electrostatic latent image is converted to a visible image (development). At this time, a voltage is applied to the developing roller by the bias power supply not illustrated. The developing roller is in contact with the photoconductive drum across a nip width of, for example, 0.5 mm or larger and 3 mm or smaller. The toner image developed on the photoconductive drum is primarily transferred to an intermediate transfer belt 26. A primary transfer member 27 is in contact with a rear surface of the intermediate transfer belt, and the negatively charged toner image is primarily transferred to the intermediate transfer belt from the photoconductive drum by applying a voltage to the primary transfer member. The primary transfer member may have a roller shape or a blade shape.

In a case where the electrophotographic image forming apparatus is a full color image-forming apparatus, typically, the above-described respective steps of charging, exposure, development, and primary transfer are carried out on each color of a yellow color, a cyan color, a magenta color, and a black color. Therefore, in the electrophotographic image forming apparatus illustrated in FIG. 2, a total of four process cartridges having a toner for each of the above-described colors (one for each color) are mounted in a state of being attachable to and detachable from the main body of the electrophotographic image forming apparatus. In addition, the above-described respective steps of charging, exposure, development, and primary transfer are sequentially carried out at predetermined time intervals, and a state in which toner images of four colors for expressing a full color image are superimposed on the intermediate transfer belt is produced.

The toner image on the intermediate transfer belt 26 is transported to a position opposite to a secondary transfer member 28 in association with the rotation of the intermediate transfer belt. Recording paper is transported along a transportation route for recording paper 31 at predetermined timings so as to be provided between the intermediate transfer belt and the secondary transfer member, and the toner image on the intermediate transfer belt is transferred to the recording paper by applying a secondary transfer bias to the secondary transfer member. The recording paper to which the toner image has been transferred by the secondary transfer member is transported to a fixation device 30. In addition, in the fixation device, the toner image on the recording paper is melted and fixed, and then the recording paper is discharged to the outside of the electrophotographic image forming apparatus, thereby terminating a printing operation.

According to an aspect of the present disclosure, it is possible to obtain a developing roller capable of preventing the generation of a difference in image density between the central portion and the end portions of an electrophotographic image. In addition, according to another aspect of the present disclosure, it is possible to obtain an electrophotographic image forming apparatus capable of stably outputting high-quality electrophotographic images. According to still another aspect of the present disclosure, it is possible to obtain a process cartridge contributing to the stable formation of high-quality electrophotographic images.

EXAMPLES

Hereinafter, the developing roller according to the present aspect will be specifically described using examples, but the developing roller according to the present disclosure is not limited to a configuration realized in the examples.

Example 1

<1. Manufacturing of Developing Roller No. 1>

(Formation of First Conductive Layer)

Materials for forming a first conductive layer shown in Table 1 were mixed together for 16 minutes using a 6 L pressure kneader (trade name: TD6-15MDX, manufactured by Toshin Co., Ltd.) at a filling ratio of 70 vol % and a blade rotation rate of 30 rpm, thereby obtaining a mixture 11.

TABLE 1

| Materials | Parts by mass |
|---|---|
| Acrylonitrile butadiene rubber (NBR) (trade name: N230SV, manufactured by JSR Corporation) | 60 |
| Epichlorohydrin rubber (trade name: EPION301, manufactured by Osaka Soda) | 40 |
| Zinc stearate | 1 |
| Zinc oxide | 5 |
| Calcium carbonate (trade name: NANOX#30, manufactured by Maruo Calcium Co., Ltd.) | 20 |
| Carbon black (trade name: TOKABLACK #7400, manufactured by Tokai Carbon Co., Ltd.) | 40 |

Next, materials shown in Table 2 were horizontally shuffled a total of 20 times in an open mill having a roll diameter of 12 inches (0.30 m) at a front roll rotation rate of 10 rpm, a rear roll rotation rate of 8 rpm, and an inter-roll distance of 2 mm. After that, the inter-roll distance was set to 0.5 mm, and the materials were tightly milled 10 times, thereby obtaining a mixture 12.

TABLE 2

| Materials | Parts by mass |
|---|---|
| Mixture 11 | 200 |
| Sulfur | 1.2 |
| Tetrabenzylthiuram disulfide (trade name: NOCCELER TBzTD, manufactured by Ouchi Shinko Chemical Industrial Co., Ltd.) | 4.5 |

A stainless steel (SUS304) cylindrical body having an outer diameter of 6 mm and a length of 270 mm was prepared. An electro-conductive vulcanizing adhesive (trade name: METALOC U-20, manufactured by Toyokagaku Kenkyusho Co., Ltd.) was applied to the circumferential surface of the cylindrical body and baked, thereby preparing a mandrel.

Next, the mixture 12 was coaxially molded in a tubular shape around the mandrel by extrusion molding for which a crosshead was used and extruded at the same time as the mandrel, and a layer of the mixture 12 was formed on the outer circumferential surface of the mandrel. As an extruder, an extruder having a cylinder diameter of 45 mm (Φ45) and L/D of 20 was used, and the temperatures were adjusted during the extrusion to 90° C. in a head, 90° C. in a cylinder, and 90° C. in a screw. Both end portions of the layer of the mixture 12 in the longitudinal direction of the mandrel were cut, and the length of the layer of the mixture 12 in the longitudinal direction of the mandrel was set to 235 mm.

After that, the layer of the mixture 12 was heated at a temperature of 160° C. for 40 minutes in an electric furnace and vulcanized, thereby forming a first conductive layer. Subsequently, the surface of the first conductive layer was polished in a crown shape using a plunger cut grinding-mode polishing machine. The outer diameter was measured using a laser length-measuring instrument (trade name: CONTROLLER LS-7000, SENSOR HEAD LS-7030R, manufactured by Keyence Corporation). The outer diameter was measured at a pitch of 1 mm, and a difference between the average of the outer diameters at a position 10 mm from the end portion of the first conductive layer and the average of the outer diameters at a position of the center of the first conductive layer was regarded as the crown amount. The outer diameter of the end portion of the first conductive layer was 10.018 mm, and the outer diameter of the central portion was 10.068 mm, and thus the crown amount was 50 μm. The crown amounts shown in Table 7 to Table 9 indicates the crown amounts of the entire conductive layer.

(Formation of Second Conductive Layer)

Materials for forming a second conductive layer shown in Table 3 were mixed together, and methyl ethyl ketone (MEK) was added thereto so that the solid content of a liquid mixture reached 40% by mass.

TABLE 3

| Materials | Parts by mass |
|---|---|
| Polyester polyol (trade name: NIPPOLLAN 3027, manufactured by Toso Corporation) | 100 |

TABLE 3-continued

| Materials | Parts by mass |
|---|---|
| MDI-based polyisocyanate (trade name: C2521, manufactured by Toso Corporation) | 103 |
| Carbon black (trade name: MA100, manufactured by Mitsubishi Chemical Corporation) | 25 |

The obtained liquid mixture (250 parts by mass) and glass beads having an average particle diameter of 0.8 mm (200 parts by mass) were dispersed for 30 minutes using a paint shaker (manufactured by Toyo Seiki Kogyo Co., Ltd.). After that, the glass beads were removed, thereby obtaining a coating liquid for forming a second conductive layer.

Next, the mandrel having the first conductive layer processed to a crown shape was immersed in and applied to the coating liquid for forming a second conductive layer in a state of being held so that the longitudinal direction of the mandrel became perpendicular to the liquid surface of the coating liquid and then air-dried at a temperature of 23° C. for 30 minutes. Next, the mandrel was dried for one hour in a circulating hot air dryer set to a temperature of 160° C., thereby forming a second conductive layer having a thickness of 11 μm on the outer circumferential surface of the first conductive layer.

The time taken for dipping, application, and immersion was nine seconds. The dipping and application lifting rate was adjusted so that the initial rate reached 20 mm/sec and the final rate reached 2 mm/sec, and, during a period of time taken for the rate to be 2 mm/sec from 20 mm/sec, the rate was linearly changed with respect to time.

(Surface Polishing)

The surface of the second conductive layer was polished using a rubber roller mirror plane processing machine (trade name: SZC, manufactured by Minakuchi Machinery Works Ltd.), and the thickness of the second conductive layer was set to 6 μm.

(Preparation of Material of Electrically Insulating Portion)

Materials shown in Table 4 were mixed together, thereby preparing a liquid for forming an electrically insulating portion that serves as the first region.

TABLE 4

| Materials | Parts by mass |
|---|---|
| Polybutadiene methacrylate (trade name: EMA-3000, manufactured by Nippon Soda Co., Ltd.) | 30 |
| Isooctyl acrylate (trade name: SR506NS, manufactured by Arkema K.K.) | 70 |
| Photoinitiator 1-hydroxycyclohexyl phenyl ketone (trade name: Omnirad 184, manufactured by IGM Resins B.V.) | 5 |

(Formation of Electrically Insulating Portion)

The mandrel was rotated at a rotation rate of 500 rpm, and the liquid was ejected onto the polished surface of the second conductive layer using a piezoelectric ink jet head. The amount of liquid droplets from the ink jet head was adjusted so as to be 15 pl.

The liquid was ejected so that the pitches (center-to-center distances) of dots of the liquid attached onto the second conductive layer in each of the circumferential direction of the second conductive layer and the mandrel direction reached 100 μm. Next, ultraviolet rays having a wavelength of 254 nm were radiated to the respective dots of the liquid for five minutes using a metal halide lamp so that the integrated light quantity reached 1,500 mJ/cm$^2$, thereby forming electrically insulating portions on the outer surface of the second conductive layer. A developing roller No. 1 in which the first regions formed protrusions was manufactured.

<2. Measurement of Physical Properties>

(Confirmation of First Regions and Second Regions)

The presence of the first regions and the second regions on the outer surface of the developing roller No. 1 was confirmed by observing the outer surface of the developing roller No. 1 using an optical microscope or a scanning electron microscope.

(Observation of Outer Surface of Developing Roller)

Hereinafter, a method for observing the developing roller No. 1 will be described.

First, the outer surface of the developing roller No. 1 was observed using an optical microscope (trade name: VHX 5000, manufactured by Keyence Corporation), and the presence of two or more regions on the outer surface was confirmed. Next, a flake including the outer surface of the developing roller No. 1 was cut out from the developing roller No. 1 using a cryomicrotome (trade name: UC-6, manufactured by Leica Microsystems). The flake was cut out at a temperature of −150° C. in a size of the outer surface of the developing roller No. 1 of 50 μm×50 μm and in a thickness of 1 μm from the outer surface of the electroconductive layer as a criterion so as to include two or more regions on the outer surface of the developing roller No. 1. Next, the surface of the cut-out flake, which had been the outer surface of the developing roller No. 1 was observed using the optical microscope.

(Measurement of Residual Potential Distribution)

Hereinafter, a method for measuring the residual potential distribution of the developing roller No. 1 will be described.

The residual potential distribution was obtained by corona-charging the surface of the flake, which had been the outer surface of the developing roller No. 1, using a corona discharging apparatus and measuring the residual potential of the surface using a surface potential microscope (trade name: MFP-3D-Origin, manufactured by Oxford Instruments) while scanning the flake.

First, the flake was placed on a flat silicon wafer so that the surface which had been the outer surface of the developing roller No. 1 faced upward and left to stand in an environment of a temperature of 23° C. and a relative humidity of 50% for 24 hours.

Subsequently, the silicon wafer on which the flake was placed was installed on a high-accuracy XY stage in the same environment. As the corona discharging apparatus, a corona discharging apparatus in which the distance between a wire and a grid electrode was 8 mm was used. The corona discharging apparatus was disposed at a position at which the distance between the grid electrode and the surface of the silicon wafer reached 2 mm. Next, the silicon wafer was grounded, and voltages of −5 kV and −0.5 kV were respectively applied to the wire and the grid electrode using an external power supply. After the initiation of the application of the voltages, the flake was scanned parallel to the surface of the silicon wafer at a rate of 20 mm/second using the high-accuracy XY stage so that the flake passed right below the corona discharging apparatus, thereby corona-charging the outer surface of the developing roller on the flake.

Subsequently, the flake was set in the surface potential microscope so that the surface including the outer surface of the developing roller on the flake became a measurement surface, and the residual potential distribution was measured. Measurement conditions are as described below.

Measurement environment: A temperature of 23° C. and a relative humidity of 50%

Time taken for the flake to pass right below the corona discharging apparatus and then initiate the measurement: 20 minutes Cantilever: Manufactured by Olympus Corporation, trade name: OMCL-AC250™

Gap between the measurement surface and the tip of the cantilever: 50 nm

Measurement range: 50 μm×50 μm

Measurement intervals: 200 nm×200 nm (50 μm/256)

The presence of a residual potential in two or more regions present on the flake was confirmed from the residual potential distribution obtained by the above-described measurement, whereby whether the respective regions were the electrically insulating first region or the second region that was more highly conductive relative to the first region was confirmed. Specifically, among the above-described two or more regions, a region including a place in which the absolute value of the residual potential was smaller than 1 V was regarded as the second region, a region including a place in which the absolute value of the residual potential was larger than the absolute value of the residual potential of the second region by 1 V or more was regarded as the first region, and the presence thereof was confirmed.

The method for measuring the residual potential distribution is simply an example, and the apparatus and the conditions may be changed to an apparatus and conditions suitable for the confirmation of the presence of the residual potentials of the two or more regions depending on the sizes, intervals, time constants, and the like of the electrically insulating portions or the electro-conductive layers.

(Measurement of Potential Decay Time Constant)

Hereinafter, a method for measuring the potential decay time constant of each of the first region and the second region of the developing roller No. 1 will be described.

The potential decay time constant was obtained by corona-charging the outer surface of the developing roller using a corona discharging apparatus, measuring the temporal transitions of the residual potentials in the first region and the second region forming the outer surface of the developing roller using an electrostatic force microscope (trade name: MODEL 1100TN, manufactured by TREK Japan), and fitting the measurement values into Expression (1).

Here, regarding the measurement point of the potential decay time constant of the first region, the potential decay time constant was measured at, in the first region confirmed by the measurement of the residual potential distribution, a point at which the absolute value of the residual potential was maximized. In addition, regarding the measurement point of the potential decay time constant of the second region, the potential decay time constant was measured at, in the second region confirmed by the measurement of the residual potential, a point at which the residual potential reached approximately 0 V.

First, the flake used for the measurement of the residual potential distribution was placed on a flat silicon wafer so that the surface including the outer surface of the developing roller No. 1 faced upward and left to stand in an environment of a temperature of 23° C. and a relative humidity of 50% for 24 hours.

Subsequently, the silicon wafer on which the flake was placed was installed on a high-accuracy XY stage into which the electrostatic force microscope had been combined in the same environment. As the corona discharging apparatus, a corona discharging apparatus in which the distance between a wire and a grid electrode was 8 mm was used. The corona discharging apparatus was disposed at a position at which the distance between the grid electrode and the surface of the silicon wafer reached 2 mm. Next, the silicon wafer was grounded, and voltages of −5 kV and −0.5 kV were respectively applied to the wire and the grid electrode using an external power supply. After the initiation of the application of the voltages, the flake was scanned parallel to the surface of the silicon wafer at a rate of 20 mm/second using the high-accuracy XY stage so that the flake passed right below the corona discharging apparatus, thereby corona-charging the flake.

Subsequently, the measurement points of the first region and the second region were moved right below the cantilever of the electrostatic force microscope using the high-accuracy XY stage, and the temporal transitions of the residual potentials were measured. For the measurement, an electrostatic force microscope was used. Measurement conditions are as described below.

Measurement environment: A temperature of 23° C. and a relative humidity of 50%

Time taken for the measurement place to pass right below the corona discharging apparatus and then initiate the measurement: 15 seconds Cantilever: Cantilever for Model 1100TH (trade name: Model 1100TNC-N, manufactured by TREK Japan)

Gap between the measurement surface and the tip of the cantilever: 10 μm

Measurement frequency: 6.25 Hz

Measurement time: 1,000 seconds

From the temporal transition of the residual potential obtained from the above-described measurement, values were fitted into Expression (1) using the least-square method, thereby obtaining a potential decay time constant τ.

$$V_0 = V(t) \times \exp(-t/\tau) \quad (1)$$

t: Elapsed time from the passing of the measurement place right below the corona discharging apparatus (seconds)

$V_0$: Initial potential (potential at the time of t=0) (V)

V(t): Residual potential after t seconds from the passing of the measurement place right below the corona discharging apparatus (V)

τ: Potential decay time constant (seconds)

At a total of nine points (three points in the longitudinal direction and three points in the circumferential direction) on the outer surface of the developing roller No. 1, the potential decay time constants τ were measured, and the average values thereof were regarded as the potential decay time constants of the first region and the second region of the developing roller No. 1. In the measurement of the potential decay time constant, in the case of including a point at which the residual potential reached approximately 0 Vat the time of initiating the measurement, that is, after 15 seconds from the corona charging, the potential decay time constant at the point was regarded as less than the average value of the potential decay time constants at the remaining measurement points. In addition, in a case where the potentials at all of the measurement points at the time of initiating the measurement were approximately 0 V, the potential decay time constant was regarded as less than the lower limit of the measurement values. The results are shown in Table 10.

(Measurement of Coating Rate of First Region)

The coating rate of the first region was measured as described below.

In a laser microscope (trade name: VK-X100, manufactured by Keyence Corporation), an object lens having an enlargement magnification of 20 times was installed, the surfaces of the developing roller No. 1 was captured in regions at a total of nine sites (three sites at angular intervals of 120° in the circumferential direction per place described below) at two places located 10 mm away from both end portions and one place in the central portion in the direction along the mandrel, and the captured images were joined together so that the length of one side reached 300 μm. In the obtained observation image, the first region and other regions were binarized using image analysis software Image J ver. 1.45 (developed by Wayne Rasband, national institutes of Health, NIH), and the area of the first region was calculated. The obtained area was divided by 90,000 $\mu m^2$, thereby calculating the coating rate of the first region. The additive average value of all of the nine sites was represented by RE, the additive average value of the three sites in the circumferential direction at the central portion was represented by RE1, and the larger additive average value of the end portion obtained by comparing the additive average value of the three sites in the circumferential direction at one end portion and the additive average value of the three sites in the circumferential direction at the other end portion was represented by RE2. The results are shown in Table 10.

(Measurement of Arithmetic Average in Circumferential Direction of Thicknesses of Electrically Insulating Portions)

The arithmetic average in the circumferential direction of the thicknesses of the electrically insulating portions (first regions) was measured as described below. Samples were cut out from the outer surface of the developing roller No. 1 using a micro scalpel so as to obtain a size of 900 (μm)×900 (μm). The samples were cut out from a total of nine sites (three sites at angular intervals of 120° in the circumferential direction per place described below) at two places located 10 mm away from both end portions and one place in the central portion in the direction along the mandrel. The obtained samples were sliced every micrometer using FIB-SEM (trade name: NVision 40, manufactured by Carl Zeiss), and 100 cross-sectional images of the samples were captured. Regarding capturing conditions, the cross-sectional images were captured at an accelerated voltage of 10 kV and a magnification of 1,000 times. Regarding the obtained cross-sectional images, the electrically insulating portions forming the first regions were three-dimensionally built using analysis software. The maximum thickness in the mandrel direction from the surface of each electrically insulating portion, which formed the first region, was measured from the three-dimensional image, and the thickness of the electrically insulating portion was obtained. The same measurement was repeated for the nine samples. The arithmetic average of all of the thicknesses obtained from the nine sites was represented by D, the arithmetic average of the three sites in the circumferential direction at the central portion was represented by D1, and the larger arithmetic average of the thicknesses obtained by comparing the arithmetic average value of the thicknesses obtained at the three sites in the circumferential direction at one end portion and the arithmetic average value of the thicknesses at the three sites in the circumferential direction at the other end portion was represented by D2. The results are shown in Table 10.

(Calculation of Coefficient of Variation of Thickness of Electrically Insulating Portion)

The standard deviation σ of data used to calculate the arithmetic average D in the circumferential direction of the thicknesses of the electrically insulating portions was calculated, and the coefficient of variation C of the thickness of the electrically insulating portion (first region) (σ/D) was calculated. The results are shown in Table 10.

<3. Evaluation of Difference in Image Density>

(Preparation of image evaluation)

First, for the purpose of lowering the torque of a developer feeding roller, a gear of a toner feeding roller was removed from a process cartridge (trade name: HP 410X High Yield Magenta Original LaserJet Toner Cartridge (CF413X), manufactured by HP Development Company, L.P.). Due to the removal of the gear, the toner feeding roller had a torque lowered with respect to the developing roller, and the amount of the toner scrapped from the developing roller decreases. Next, the produced developing roller No. 1 was combined into the process cartridge, and the process cartridge was mounted in a laser beam printer (trade name: Color Laser Jet Pro M452 dw, manufactured by HP Development Company, L.P., an output machine of paper of size 4 of an A series format in ISO216). Two laser beam printers were prepared and left to stand for 24 hours in a normal-temperature and humidity environment (temperature: 23° C., relative humidity: 50%) and in a low-temperature and humidity environment (temperature: 15° C., relative humidity: 10%) respectively.

(Image Evaluation Method)

One half-tone image was outputted from each of the laser beam printers left to stand for 24 hours in the respective environments under the same environment. Next, 30 solid white (density: 0%) images were outputted, and then one half-tone image (an image on which horizontal lines with a width of one dot extending in a direction perpendicular to the rotation direction of an electrophotographic photoreceptor were drawn at intervals of one dot in the rotation direction) was rapidly outputted. The image density of the obtained half-tone image was measured using a spectral densitometer (trade name: 508, manufactured by X-Rite Inc.).

Next, 100 solid white (density: 0%) images were outputted, and then one half-tone image was rapidly outputted. The difference in image density of the obtained half-tone image was measured in the same manner, and the difference in image density after the output of 100 solid white images was obtained.

The difference in image density was measured as described below.

The densities were measured at three points respectively in the tip of the outputted image and, in an image region as large as one circumference of the developing roller (approximately 2 cm), an end portion of the image region and the central portion of the image region, and the additive average value of the image densities at the end portion of the image region and the additive average value of the image densities at the central portion of the image region were calculated. The absolute value of the difference in image density between the end portion and the central portion was regarded as the difference in image density and evaluated using the following standards. The end portion of the image region refers to a position 10 mm inward from the image end.

Evaluation Standards

Rank A: The difference in image density is less than 0.05.

Rank B: The difference in image density is 0.05 or more and less than 0.10.

Rank C: The difference in image density is 0.10 or more and less than 0.20.

Rank D: The difference in image density is 0.20 or more

The evaluation results are shown in Table 11. In Table 11, the evaluation results of the half-tone image outputted after the output of 30 solid white images in the normal-temperature and humidity environment are expressed as Evaluation (1), and the evaluation results of the half-tone image outputted after the output of 100 solid white images in the low-temperature and humidity environment are expressed as Evaluation (2).

Example 2

Materials for forming an electro-conductive layer shown in Table 5 were mixed together for 16 minutes using a 6 L pressure kneader (trade name: TD6-15MDX, manufactured by Toshin Co., Ltd.) at a filling ratio of 70 vol % and a blade rotation rate of 30 rpm, thereby obtaining a mixture 21.

TABLE 5

| Materials | Parts by mass |
|---|---|
| Acrylonitrile-butadiene rubber (NBR) (trade name: N230SV, manufactured by JSR Corporation) | 60 |
| Epichlorohydrin rubber (trade name: EPION301, manufactured by Osaka Soda) | 40 |
| Zinc stearate | 1 |
| Zinc oxide | 5 |
| Calcium carbonate (trade name: NANOX#30, manufactured by Maruo Calcium Co., Ltd.) | 20 |
| Carbon black (trade name: TOKABLACK #7400, manufactured by Tokai Carbon Co., Ltd.) | 40 |
| Spherical polyethylene particles (trade name: MIPELON XM-220, manufactured by Mitsui Chemicals, Inc.) | 50 |

Next, the mixture 21 was horizontally shuffled a total of 20 times in an open mill having a roll diameter of 12 inches (0.30 m) at a front roll rotation rate of 10 rpm, a rear roll rotation rate of 8 rpm, and an inter-roll distance of 2 mm. After that, the inter-roll distance was set to 0.5 mm, and the mixture was tightly milled 10 times, thereby obtaining a mixture 22. An electro-conductive layer was formed on the circumferential surface of a cylindrical body in the same manner as in the method for forming the first conductive layer in Example 1 with the exception that the mixture 22 was used.

Subsequently, the surface of the electro-conductive layer was polished in a crown shape using a plunger cut grinding-mode polishing machine, and a developing roller No. 2 having a crown shape was obtained. In addition, in the polishing step, some of spherical polyethylene particles included in the electro-conductive layer were polished, and, consequently, electrically insulating portions derived from the spherical polyethylene particles were exposed on the outer surface of the electro-conductive layer. For the developing roller No. 2, the physical properties were measured and the images were evaluated using the same methods as in Example 1. The results are shown in Table 10 and Table 11.

Examples 3 to 13 and Comparative Examples 1 and 2

The amounts of carbon black (CB) added to the mixture 22 for forming the electro-conductive layer of Example 2 were set as shown in Table 7, and the kinds and amounts added of particles corresponding to the spherical polyethylene particles were set as shown in Table 7. In addition, the crown amounts of the electro-conductive layers were changed as shown in Table 7 respectively. Except for the above, a developing roller No. 3 to a developing roller No. 13, a developing roller No. C1, and a developing roller No. C2 were produced in the same manner as in Example 2, and the physical properties were measured and the images were evaluated using the same methods as in Example 1. The results are shown in Table 10 and Table 11.

Example 14

(Formation of First Conductive Layer)

A mandrel having a first conductive layer on the outer circumferential surface was prepared in the same manner as in Example 1.

(Formation of Second Conductive Layer)

To the coating liquid for forming the second conductive layer in Example 1, spherical polyethylene particles (trade name: MIPELON XM-200, manufactured by Mitsui Chemicals, Inc.) (30 parts by mass) were further added, thereby producing a coating liquid for forming a second conductive layer in the present example. The spherical polyethylene particles are electrically insulating particles for forming electrically insulating portions that form the second regions. Next, a second conductive layer having a thickness of 11 μm was formed in the same manner as in Example 1 with the exception that the above-described coating liquid was used. The thickness is a film thickness in a portion (second region) other than the electrically insulating particles (resin particles), which is also true for an amount polished and a film thickness after polishing described below.

(Surface Polishing)

The surface of the second conductive layer was polished 5 μm in the thickness direction using a rubber roller mirror plane processing machine (trade name: SZC, manufactured by Minakuchi Machinery Works Ltd.), and the film thickness of the second conductive layer was set to 6 μm. In addition, in the polishing step, some of spherical polyethylene particles included in the second conductive layer were polished, and, consequently, electrically insulating portions derived from the spherical polyethylene particles were exposed on the outer surface of the second conductive layer. A developing roller No. 14 according to the present example was manufactured as described above. For the developing roller No. 14, the physical properties were measured and the images were evaluated using the same methods as in Example 1. The results are shown in Table 10 and Table 11.

In the developing roller No. 14, the upper limit of the thickness of the electrically insulating portion can be regulated using the film thickness of the second conductive layer, and thus it is possible to almost even the thicknesses of the electrically insulating portions. The coefficient of variation C of the arithmetic average D in the circumferential direction of the thicknesses of the electrically insulating portions of the developing roller No. 14 was 0.16.

Examples 15 to 27 and Comparative Example 3

At least one of the amount of carbon black (CB) added to the coating liquid for forming the second conductive layer of Example 14, the particles for forming the electrically insulating portion, the amount of the particles for forming the electrically insulating portion added, the crown amount of the electro-conductive layer, and the film thickness of the second conductive layer after polishing was changed as shown in Table 8. Except for the above, a developing roller No. 15 to a developing roller No. 27 according to Examples 15 to 27 and a developing roller No. C3 according to Comparative Example 3 were manufactured in the same manner as in Example 14. Regarding the film thickness of the second conductive layer after polishing, the film thickness of the second conductive layer after polishing was made to be a value shown in Table 8 by changing the application lifting rate during the dipping of the mandrel into the coating liquid for forming the second conductive layer and adjusting the film thickness of the second conductive layer before polishing. Regarding the developing roller No. 15 to the developing roller No. 27 and the developing roller No. C3, the physical properties were measured and the images were evaluated using the same methods as in Example 1. The results are shown in Table 10 and Table 11.

In the developing roller No. 15 to the developing roller No. 27 and the developing roller No. C3, the electrically insulating portions derived from the electrically insulating particles were exposed on the outer surface of the second conductive layer.

Comparative Example 4

A developing roller No. C4 was produced in the same manner as in Example 20 with the exception that the surface of the second conductive layer formed on the first conductive layer was not polished, and the physical properties were measured and the images were evaluated in the same manner as in Example 1. The results are shown in Table 10 and Table 11. For the developing roller No. C4, the surface of the second conductive layer was not polished, and thus the electrically insulating portions were not exposed on the outer surface of the second conductive layer, and the first regions were not present.

Examples 28 to 31

In Example 15, the material of the second conductive layer was changed to materials shown in Table 8. In addition, the dipping and application lifting rate was changed, and the film thickness of the second conductive layer obtained after the polishing of the surface was changed to values shown in Table 8. Except for the above, a developing roller No. 28 to a developing roller No. 31 were manufactured using the same method as in Example 15. In these developing rollers, the second conductive layers included electrically insulating particles, and the surfaces of electrically insulating portions on which the electrically insulating particles were polished and exposed were regarded as the first regions.

For the obtained developing roller No. 28 to developing roller No. 31, the physical properties were measured and the images were evaluated using the same methods as in Example 1. The results are shown in Table 10 and Table 11.

In the developing roller No. 28 and the developing roller No. 29, the film thicknesses of the second conductive layers that regulated the thicknesses of the electrically insulating portions were changed. Specifically, the film thickness of the second conductive layer at the central portion was set to be smaller than the film thickness at the end portion, thereby making D1 smaller than D2. In addition, in the developing roller No. 30 and the developing roller No. 31, the particle diameters of the electrically insulating particles were set to be larger than those in the developing roller No. 28, thereby making the coating rate RE1 smaller than RE2.

Examples 32 to 41 and Comparative Example 5

In Example 1, the crown amount of the electro-conductive layer, the additive in the second conductive layer, the material of the electrically insulating portion, the amount of the liquid droplet were respectively changed as shown in Table 9. Except for the above, a developing roller No. 32 to a developing roller No. 41 and a developing roller No. C5 were manufactured using the same method as in Example 1.

Regarding the obtained developing roller No. 32 to developing roller No. 41 and developing roller No. C5, the physical properties were measured and the images were evaluated using the same methods as in Example 1. The results are shown in Table 10 and Table 11. The change in the additive in the second conductive layer changed the values of D corresponding to the height of the protrusion or the coating ratios of the first regions.

Example 42

(Formation of First Conductive Layer)

A mandrel having a first conductive layer on the outer circumferential surface was prepared in the same manner as in Example 1.

(Formation of Second Conductive Layer)

Materials for forming a second conductive layer shown in Table 6 were mixed together, and methyl ethyl ketone (MEK) was added thereto so that the concentration of the solid content reached 40% by mass, thereby preparing a liquid mixture.

TABLE 6

| Materials | Parts by mass |
|---|---|
| Polyester polyol (trade name: NIPPOLLAN 3027, manufactured by Toso Corporation) | 100 |
| MDI-based polyisocyanate (trade name: C2521, manufactured by Toso Corporation) | 103 |
| Carbon black (trade name: MA100, manufactured by Mitsubishi Chemical Corporation) | 25 |
| Silicone oil (trade name: TSF4440, manufactured by Momentive Performance Materials) | 1 |

The liquid mixture (250 parts by mass) and glass beads having an average particle diameter of 0.8 mm (200 parts by mass) were dispersed for 30 minutes using a paint shaker (manufactured by Toyo Seiki Kogyo Co., Ltd.). After that, the glass beads were removed, thereby obtaining a coating liquid for forming a second conductive layer. Next, a second conductive layer having a thickness of 11 μm was formed in the same manner as in Example 1 with the exception that the above-described coating liquid was used.

(Surface Polishing)

The surface of the second conductive layer was polished 5 μm in the thickness direction using a rubber roller mirror plane processing machine (trade name: SZC, manufactured by Minakuchi Machinery Works Ltd.), and the film thickness of the second conductive layer was set to 6 μm.

(Preparation of Coating Liquid for Electrically Insulating Portion)

Materials shown in Table 9 were mixed together, and methyl ethyl ketone (MEK) was added thereto so that the solid content reached 15% by mass, thereby producing a coating liquid for forming an electrically insulating portion.

(Formation of Electrically Insulating Portion)

The mandrel having the first conductive layer and the second conductive layer having a polished outer surface laminated on the circumferential surface was dipped into the coating liquid, thereby forming a layer of the coating liquid on the outer surface of the second conductive layer. Dipping conditions were the same as those for the formation of the second conductive layer.

Next, the mandrel was dried for one hour in a circulating hot air dryer set to a temperature of 160° C., and then ultraviolet rays having a wavelength of 254 nm were radiated for five minutes using a metal halide lamp so that the integrated light quantity reached 1,500 mJ/cm$^2$, thereby curing the layer, forming electrically insulating portions on the outer surface of the second conductive layer, and obtaining a developing roller No. 42. In the developing roller No. 42, the electrically insulating portions projected in a protrusion shape from the outer surface of the second conductive layer. Regarding the obtained developing roller No. 42, the physical properties were measured and the images were evaluated using the same methods as in Example 1. The results are shown in Table 10 and Table 11.

TABLE 7

| | | Developing roller No. | Amount of CB added (parts by mass) | Particles for forming electrically insulating portion: Kind | Particles for forming electrically insulating portion: Amount added (parts by mass) | Crown amount (μm) |
|---|---|---|---|---|---|---|
| Examples | 1 | 1 | 40 | — | — | 50 |
| | 2 | 2 | 40 | Spherical polyethylene particles (trade name: MIPELON XM-220, manufactured by Mitsui Chemicals, Inc.) | 30 | 50 |
| | 3 | 3 | 40 | Spherical polyethylene particles (trade name: MIPELON XM-220, manufactured by Mitsui Chemicals, Inc.) | 12 | 50 |
| | 4 | 4 | 40 | Spherical polyethylene particles (trade name: MIPELON XM-220, manufactured by Mitsui Chemicals, Inc.) | 45 | 50 |
| | 5 | 5 | 40 | Spherical polyethylene particles (trade name: MIPELON XM-220, manufactured by Mitsui Chemicals, Inc.) | 30 | 25 |
| | 6 | 6 | 40 | Spherical polyethylene particles (trade name: MIPELON XM-220, manufactured by Mitsui Chemicals, Inc.) | 30 | 150 |
| | 7 | 7 | 40 | Fine resin particles (trade name SP-230, manufactured by Sekisui Chemical Co., Ltd.) | 30 | 50 |
| | 8 | 8 | 55 | Spherical polyethylene particles (trade name: MIPELON XM-220, manufactured by Mitsui Chemicals, Inc.) | 30 | 50 |
| | 9 | 9 | 5 | Spherical polyethylene particles (trade name: MIPELON XM-220, manufactured by Mitsui Chemicals, Inc.) | 30 | 50 |
| | 10 | 10 | 40 | Granular acryl beads (trade name: SE-006T, manufactured by Negami Chemical Industrial Co., Ltd.) | 30 | 50 |
| | 11 | 11 | 40 | Granular acryl beads (trade name: SE-030T, manufactured by Negami Chemical Industrial Co., Ltd.) | 30 | 50 |
| | 12 | 12 | 40 | Granular acryl beads (trade name: SE-050T, manufactured by Negami Chemical Industrial Co., Ltd.) | 30 | 50 |
| | 13 | 13 | 40 | Crosslinked acrylic narrow-dispersion particles (trade name: MX-3000, manufactured by Soken Chemical & Engineering Co., Ltd.) | 30 | 50 |
| Comparative Example 1 | | C1 | 40 | — | — | 50 |
| Comparative Example 2 | | C2 | 40 | Spherical polyethylene particles (trade name: MIPELON XM-220, manufactured by Mitsui Chemicals, Inc.) | 30 | — |

TABLE 8

| | | | Second conductive layer: Crown amount (μm) | Second conductive layer: Amount of CB added (parts by mass) | Second conductive layer: Particles for forming electrically insulating portion: Kind | Second conductive layer: Particles for forming electrically insulating portion: Amount added (parts by mass) | Second conductive layer: Film thickness (μm) |
|---|---|---|---|---|---|---|---|
| Examples | 14 | 14 | 50 | 25 | Spherical polyethylene particles (trade name: MIPELON XM-220, manufactured by Mitsui Chemicals, Inc.) | 30 | 6 |
| | 15 | 15 | 50 | 25 | Spherical polyethylene particles (trade name: MIPELON XM-220, manufactured by Mitsui Chemicals, Inc.) | 12 | 6 |

TABLE 8-continued

| | | | | Second conductive layer | | | |
|---|---|---|---|---|---|---|---|
| | | | Crown | Amount of CB added | Particles for forming electrically insulating portion | | Film |
| | | Developing roller No. | amount (μm) | (parts by mass) | Kind | Amount added (parts by mass) | thickness (μm) |
| | 16 | 16 | 50 | 25 | Spherical polyethylene particles (trade name: MIPELON XM-220, manufactured by Mitsui Chemicals, Inc.) | 45 | 6 |
| | 17 | 17 | 25 | 25 | Spherical polyethylene particles (trade name: MIPELON XM-220, manufactured by Mitsui Chemicals, Inc.) | 30 | 6 |
| | 18 | 18 | 150 | 25 | Spherical polyethylene particles (trade name: MIPELON XM-220, manufactured by Mitsui Chemicals, Inc.) | 30 | 6 |
| | 19 | 19 | 50 | 25 | Fine resin particles (trade name SP-230, manufactured by Sekisui Chemical Co., Ltd.) | 30 | 6 |
| | 20 | 20 | 50 | 40 | Spherical polyethylene particles (trade name: MIPELON XM-220, manufactured by Mitsui Chemicals, Inc.) | 30 | 6 |
| | 21 | 21 | 50 | 10 | Spherical polyethylene particles (trade name: MIPELON XM-220, manufactured by Mitsui Chemicals, Inc.) | 30 | 6 |
| | 22 | 22 | 50 | 25 | Granular acryl beads (trade name: SE-006T, manufactured by Negami Chemical Industrial Co., Ltd.) | 30 | 1 |
| | 23 | 23 | 50 | 25 | Granular acryl beads (trade name: SE-030T, manufactured by Negami Chemical Industrial Co., Ltd.) | 30 | 6 |
| | 24 | 24 | 50 | 25 | Granular acryl beads (trade name: SE-050T, manufactured by Negami Chemical Industrial Co., Ltd.) | 30 | 10 |
| | 25 | 25 | 50 | 25 | Spherical polyethylene particles (trade name: MIPELON XM-220, manufactured by Mitsui Chemicals, Inc.) | 30 | 20 |
| | 26 | 26 | 50 | 25 | Spherical polyethylene particles (trade name: MIPELON XM-220, manufactured by Mitsui Chemicals, Inc.) | 30 | 45 |
| | 27 | 27 | 50 | 25 | Crosslinked acrylic narrow-dispersion particles (trade name: MX-3000, manufactured by Soken Chemical & Engineering Co., Ltd.) | 30 | 10 |
| | 28 | 28 | 50 | 25 | Spherical polyethylene particles (trade name: MIPELON XM-220, manufactured by Mitsui Chemicals, Inc.) | 30 | 10 in central, 15 in end portion |
| | 29 | 29 | 50 | 25 | Spherical polyethylene particles (trade name: MIPELON XM-220, manufactured by Mitsui Chemicals, Inc.) | 30 | 10 in central, 20 in end portion |
| | 30 | 30 | 50 | 25 | Granular acryl beads (trade name: SE-030T, manufactured by Negami Chemical Industrial Co., Ltd.) | 30 | 15 |
| | 31 | 31 | 50 | 25 | Granular acryl beads (trade name: SE-050T, manufactured by Negami Chemical Industrial Co., Ltd.) | 30 | 25 |
| Comparative Example 3 | | C3 | 50 | 5 | Spherical polyethylene particles (trade name: MIPELON XM-220, manufactured by Mitsui Chemicals, Inc.) | 30 | 10 |
| Comparative Example 4 | | C4 | 50 | 40 | Spherical polyethylene particles (trade name: MIPELON XM-220, manufactured by Mitsui Chemicals, Inc.) | 30 | 11 (not polished) |

TABLE 9

| | | Developing roller No. | Crown amount (μm) | Additive in second conductive layer | Material of electrically insulating portion | Amount of liquid droplets (pl) |
|---|---|---|---|---|---|---|
| Examples | 32 | 32 | 50 | TSF4440 1 part by mass (manufactured by Momentive Performance Materials) | EMA-3000 30 parts<br>SR506NS 70 parts<br>Omnirad184 5 parts | 10 |

TABLE 9-continued

| | | Developing roller No. | Crown amount (μm) | Additive in second conductive layer | Material of electrically insulating portion | Amount of liquid droplets (pl) |
|---|---|---|---|---|---|---|
| | 33 | 33 | 50 | TSF4445 1 part by mass (manufactured by Momentive Performance Materials) | EMA-3000 50 parts<br>SR506NS 50 parts<br>Omnirad184 5 parts | 15 |
| | 34 | 34 | 25 | — | EMA-3000 30 parts<br>SR506NS 70 parts<br>Omnirad184 5 parts | 15 |
| | 35 | 35 | 150 | — | EMA-3000 30 parts<br>SR506NS 70 parts<br>Omnirad184 5 parts | 15 |
| | 36 | 36 | 50 | — | FA513AS 20 parts (manufactured by Hitachi Chemical Co., Ltd.)<br>Biscoat #150 80 parts (manufactured by Osaka Organic Chemical Industry Ltd.)<br>Omnirad184 5 parts | 15 |
| | 37 | 37 | 50 | — | SR217 40 parts (manufactured by Arkema K.K)<br>SR506NS 60 parts<br>Omnirad184 5 parts | 15 |
| | 38 | 38 | 50 | — | EMA-3000 30 parts<br>SR506NS 70 parts<br>Omnirad184 5 parts | 15 |
| | 39 | 39 | 50 | — | EMA-3000 30 parts<br>SR506NS 70 parts<br>Omnirad184 5 parts | 15 |
| | 40 | 40 | 50 | TSF4440 1 part by mass (manufactured by Momentive Performance Materials) | EMA-3000 15 parts<br>SR506NS 85 parts<br>Omnirad184 5 parts | 15 |
| | 41 | 41 | 50 | TSF4440 1 part by mass (manufactured by Momentive Performance Materials) | EMA-3000 30 parts<br>SR506NS 70 parts<br>Omnirad184 5 parts | 15 |
| | 42 | 42 | 50 | TSF4440 1 part by mass (manufactured by Momentive Performance Materials) | EMA-3000 30 parts<br>SR506NS 70 parts<br>Omnirad184 5 parts | (Produced by dipping) |
| Comparative Example 5 | | C5 | — | — | EMA-3000 30 parts<br>SR506NS 70 parts<br>Omnirad184 5 parts | 15 |

TABLE 10

| | | Potential decay time constant τ (seconds) | | Coating rate of first region (%) | | | Average D of thicknesses of electrically insulating portions (μm) | | | Coefficient of variation C |
|---|---|---|---|---|---|---|---|---|---|---|
| | | First region | Second region | RE | RE1 | RE2 | D | D1 | D2 | |
| Examples | 1 | 94.8 | Less than measurement lower limit | 26 | 26 | 26 | 8 | 8 | 8 | 0.09 |
| | 2 | 95.6 | Less than measurement lower limit | 28 | 28 | 28 | 15 | 15 | 15 | 0.72 |
| | 3 | 83.2 | Less than measurement lower limit | 11 | 11 | 11 | 15 | 15 | 15 | 0.74 |
| | 4 | 69.9 | Less than measurement lower limit | 58 | 58 | 59 | 15 | 15 | 15 | 0.74 |
| | 5 | 95.0 | Less than measurement lower limit | 28 | 28 | 28 | 15 | 15 | 15 | 0.77 |
| | 6 | 69.7 | Less than measurement lower limit | 28 | 28 | 28 | 15 | 15 | 15 | 0.75 |
| | 7 | 68.1 | Less than measurement lower limit | 28 | 28 | 28 | 15 | 15 | 15 | 0.73 |
| | 8 | 96.8 | Less than measurement lower limit | 28 | 28 | 28 | 15 | 15 | 15 | 0.77 |
| | 9 | 76.3 | 2.6 | 28 | 28 | 28 | 15 | 15 | 15 | 0.73 |
| | 10 | 110.7 | Less than measurement lower limit | 28 | 28 | 28 | 15 | 15 | 15 | 0.70 |
| | 11 | 111.7 | Less than measurement lower limit | 28 | 28 | 28 | 15 | 15 | 15 | 0.75 |
| | 12 | 115.6 | Less than measurement lower limit | 28 | 28 | 28 | 15 | 15 | 15 | 0.73 |
| | 13 | 89.4 | Less than measurement lower limit | 28 | 28 | 28 | 15 | 15 | 15 | 0.65 |
| | 14 | 96.5 | Less than measurement lower limit | 28 | 28 | 28 | 6 | 6 | 6 | 0.16 |
| | 15 | 70.2 | Less than measurement lower limit | 12 | 12 | 12 | 6 | 6 | 6 | 0.20 |
| | 16 | 93.6 | Less than measurement lower limit | 55 | 55 | 54 | 6 | 6 | 6 | 0.16 |
| | 17 | 69.1 | Less than measurement lower limit | 28 | 28 | 28 | 6 | 6 | 6 | 0.18 |
| | 18 | 91.5 | Less than measurement lower limit | 28 | 28 | 28 | 6 | 6 | 6 | 0.16 |
| | 19 | 66.5 | Less than measurement lower limit | 28 | 28 | 28 | 6 | 6 | 6 | 0.17 |

TABLE 10-continued

| | | Potential decay time constant τ (seconds) | | Coating rate of first region (%) | | | Average D of thicknesses of electrically insulating portions (μm) | | | Coefficient of variation C |
|---|---|---|---|---|---|---|---|---|---|---|
| | | First region | Second region | RE | RE1 | RE2 | D | D1 | D2 | |
| | 20 | 96.5 | Less than measurement lower limit | 28 | 28 | 28 | 6 | 6 | 6 | 0.20 |
| | 21 | 87.5 | 1.3 | 28 | 28 | 28 | 6 | 6 | 6 | 0.17 |
| | 22 | 110.6 | Less than measurement lower limit | 28 | 28 | 28 | 1 | 1 | 1 | 0.21 |
| | 23 | 111.0 | Less than measurement lower limit | 28 | 28 | 28 | 6 | 6 | 6 | 0.20 |
| | 24 | 111.6 | Less than measurement lower limit | 28 | 28 | 28 | 10 | 10 | 10 | 0.17 |
| | 25 | 89.7 | Less than measurement lower limit | 28 | 28 | 28 | 21 | 19 | 21 | 0.28 |
| | 26 | 77.8 | Less than measurement lower limit | 28 | 28 | 28 | 14 | 15 | 15 | 0.49 |
| | 27 | 89.3 | Less than measurement lower limit | 28 | 28 | 28 | 10 | 10 | 10 | 0.08 |
| | 28 | 76.8 | Less than measurement lower limit | 28 | 28 | 29 | 10 | 10 | 15 | 0.22 |
| | 29 | 92.5 | Less than measurement lower limit | 28 | 28 | 29 | 10 | 10 | 20 | 0.23 |
| | 30 | 107.5 | Less than measurement lower limit | 30 | 28 | 35 | 15 | 15 | 17 | 0.26 |
| | 31 | 114.3 | Less than measurement lower limit | 32 | 29 | 40 | 25 | 25 | 27 | 0.21 |
| | 32 | 64.1 | Less than measurement lower limit | 9 | 9 | 9 | 8 | 8 | 8 | 0.12 |
| | 33 | 86.9 | Less than measurement lower limit | 60 | 60 | 60 | 8 | 8 | 8 | 0.14 |
| | 34 | 81.9 | Less than measurement lower limit | 26 | 26 | 26 | 8 | 8 | 8 | 0.12 |
| | 35 | 71.4 | Less than measurement lower limit | 26 | 26 | 26 | 8 | 8 | 8 | 0.14 |
| | 36 | 62.6 | Less than measurement lower limit | 26 | 26 | 26 | 8 | 8 | 8 | 0.12 |
| | 37 | 262.9 | Less than measurement lower limit | 26 | 26 | 26 | 8 | 8 | 8 | 0.14 |
| | 38 | 87.0 | Less than measurement lower limit | 26 | 26 | 26 | 8 | 8 | 8 | 0.14 |
| | 39 | 79.1 | 1.5 | 26 | 26 | 26 | 8 | 8 | 8 | 0.14 |
| | 40 | 91.5 | Less than measurement lower limit | 28 | 28 | 28 | 8 | 8 | 8 | 0.13 |
| | 41 | 81.3 | Less than measurement lower limit | 28 | 28 | 28 | 15 | 15 | 15 | 0.10 |
| | 42 | 93.9 | Less than measurement lower limit | 28 | 28 | 28 | 14 | 16 | 15 | 0.56 |
| Comparative Examples | 1 | — | Less than measurement lower limit | — | — | — | — | — | — | — |
| | 2 | 86.7 | Less than measurement lower limit | 28 | 28 | 28 | 15 | 15 | 15 | 0.74 |
| | 3 | 89.3 | 91.9 | 26 | 26 | 26 | 8 | 8 | 8 | 0.12 |
| | 4 | — | Less than measurement lower limit | — | — | — | — | — | — | — |
| | 5 | 96.2 | Less than measurement lower limit | 28 | 28 | 28 | 6 | 6 | 6 | 0.54 |

TABLE 11

| | | Evaluation ranks for difference in image density | | | |
|---|---|---|---|---|---|
| | | Normal-temperature and humidity environment | | Low-temperature and humidity environment | |
| | | Evaluation (1) | Evaluation (2) | Evaluation (1) | Evaluation (2) |
| Examples | 1 | A | A | A | B |
| | 2 | B | C | C | C |
| | 3 | C | C | C | C |
| | 4 | C | C | C | C |
| | 5 | B | C | C | C |
| | 6 | B | C | C | C |
| | 7 | C | C | C | C |
| | 8 | C | C | C | C |
| | 9 | C | C | C | C |
| | 10 | C | C | C | C |
| | 11 | B | C | B | C |
| | 12 | B | C | B | C |
| | 13 | B | B | B | C |
| | 14 | A | B | B | C |
| | 15 | B | C | B | C |
| | 16 | B | C | B | C |
| | 17 | B | B | B | C |
| | 18 | B | B | B | C |
| | 19 | B | B | B | C |
| | 20 | B | C | B | C |
| | 21 | B | C | B | C |
| | 22 | B | B | B | C |
| | 23 | B | B | B | B |
| | 24 | B | B | B | B |
| | 25 | B | B | B | B |
| | 26 | B | B | B | B |
| | 27 | A | B | A | B |
| | 28 | A | B | B | C |
| | 29 | A | B | B | C |

TABLE 11-continued

| | | Evaluation ranks for difference in image density | | | |
|---|---|---|---|---|---|
| | | Normal-temperature and humidity environment | | Low-temperature and humidity environment | |
| | | Evaluation (1) | Evaluation (2) | Evaluation (1) | Evaluation (2) |
| | 30 | A | C | B | B |
| | 31 | A | C | B | B |
| | 32 | A | B | A | B |
| | 33 | A | B | A | B |
| | 34 | A | A | A | B |
| | 35 | A | A | A | B |
| | 36 | A | A | A | B |
| | 37 | A | A | A | B |
| | 38 | A | C | A | B |
| | 39 | A | A | A | B |
| | 40 | A | A | A | B |
| | 41 | A | A | A | A |
| | 42 | A | B | A | B |
| Comparative Examples | 1 | C | C | C | D |
| | 2 | D | D | D | D |
| | 3 | D | D | D | D |
| | 4 | C | C | C | D |
| | 5 | D | D | D | D |

As shown in Table 10 and Table 11, it was found that, when the developing rollers according to Examples 1 to 42 are used, it is possible to suppress the maldistribution of toners in the end portions. In the developing rollers of Examples 1 and 14 to 41, the coefficient of variation C was lower than 0.5, and thus a change in the densities of images was further suppressed. In the developing rollers of Examples 28 and 29, the thicknesses of the electrically insulating portions in the end portions were thicker than those in the central portion, and thus an effect for further suppressing a change in the density of an image could be obtained. In addition, in the developing rollers of Examples 30 and 31, the proportion of the area of the first region in the end portion was larger than that in the central portion, and thus an effect for further suppressing a change in the density of an image could be obtained. Additionally, in particular, in the developing rollers of Examples 1 and 32 to 42, the electrically insulating portion formed the protrusion, and thus an effect for further suppressing a change in the density of an image could be obtained.

On the other hand, in the developing rollers of Comparative Examples 1 to 5, results of significant changes in the densities of images were obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-160944, filed Aug. 30, 2018, which is hereby incorporated by reference herein in its entirety.

What is claimed is:

1. A developing roller, comprising:

an electro-conductive mandrel; and an electro-conductive layer on the mandrel, the electro-conductive layer having a crown shape in which an outer diameter of a central portion in a direction along the mandrel is larger than outer diameters of both end portions in the direction along the mandrel, and an outer surface of the developing roller including electrically insulating first regions constituted by electrically insulating portions and a second region whose electro-conductivity is higher than that of the first regions, each of the first regions being adjacent to the second region, wherein a coefficient of variation C of D is lower than 0.5 when D (μm) is an arithmetic average in a circumferential direction of thicknesses of the electrically insulating portions, C is represented by σ/D,and σ represents a standard deviation of a distribution of the thicknesses of the electrically insulating portions, and D1 is smaller than D2 when D1 is an arithmetic average of thicknesses of the electrically insulating portions in a circumferential direction which are positioned in a central part in the direction along the mandrel, and D2 is an arithmetic average in a circumferential direction of thicknesses of the electrically insulating portions positioned in at least one end part in the direction along the mandrel.

2. The developing roller according to claim 1, wherein a potential decay time constant defined as a period of time necessary for a potential of a surface of each of the first regions to decay to $V_0 \times (1/e)$ (V) is 60.0 seconds or longer when the developing roller is electrically charged so that a potential of a surface of each of the first regions constituting a part of an outer surface of the developing roller is $V_0$ (V).

3. The developing roller according to claim 1, wherein a potential decay time constant defined as a period of time necessary for a potential of a surface of the second region to decay to $V_0 \times (1/e)$ (V) is shorter than 6.0 seconds when the developing roller is electrically charged so that a potential of a surface of the second region constituting a part of an outer surface of the developing roller is $V_0$ (V).

4. The developing roller according to claim 1, wherein when a 300 μm×300 μm square region is put on the outer surface of the developing roller so that one side of the square region is parallel to a direction along the mandrel of the developing roller, a proportion of a total area of the first regions in an area of the square region is 10 to 60% or less.

5. The developing roller according to claim 1, having protrusions in the outer surface, wherein the protrusions are constituted by each of the first regions.

6. A process cartridge which is configured to be attachable to and detachable from a main body of an electrophotographic image forming apparatus and comprises a developing roller, the developing roller comprising:

an electro-conductive mandrel; and an electro-conductive layer on the mandrel, the electro-conductive layer having a crown shape in which an outer diameter of a central portion in a direction along the mandrel is larger than outer diameters of both end portions in the direction along the mandrel, and an outer surface of the developing roller including electrically insulating first regions constituted by electrically insulating portions and a second region whose electro-conductivity is higher than that of the second regions, each of the first regions being adjacent to the second region, wherein a coefficient of variation C of D is lower than 0.5 when D (μm) is an arithmetic average in a circumferential direction of thicknesses of the electrically insulating portions, C is represented by σ/D,and σ represents a standard deviation of a distribution of the thicknesses of the electrically insulating portions, and D1 is smaller than D2 when D1 is an arithmetic average of thicknesses of the electrically insulating portions in a circumferential direction which are positioned in a central part in the direction along the mandrel, and D2 is an arithmetic average in a circumferential direction of thicknesses of the electrically insulating portions positioned in at least one end part in the direction along the mandrel.

7. A developing roller, comprising:

an electro-conductive mandrel; and an electro-conductive layer on the mandrel, the electro-conductive layer having a crown shape in which an outer diameter of a central portion in a direction along the mandrel is larger than outer diameters of both end portions in the direction along the mandrel, and an outer surface of the developing roller includes electrically insulating first regions and a second region whose electro-conductivity is higher than that of the first regions, each of the first regions being adjacent to the second region, wherein in the direction along the mandrel, a proportion of an area of the first regions in at least one end part of the developing roller is larger than a proportion of an area of the first regions in the central part of the developing roller.

8. The developing roller according to claim 7, wherein a potential decay time constant defined as a period of time necessary for a potential of a surface of each of the first regions to decay to $V_0 \times (1/e)$ (V) is 60.0 seconds or longer when the developing roller is electrically charged so that a potential of a surface of each of the first regions constituting a part of an outer surface of the developing roller is $V_0$ (V).

9. The developing roller according to claim 7, wherein a potential decay time constant defined as a period of time necessary for a potential of a surface of the second region to decay to $V_0 \times (1/e)$ (V) is shorter than 6.0 seconds when the developing roller is electrically charged so that a potential of a surface of the second region constituting a part of an outer surface of the developing roller is $V_0$ (V).

10. The developing roller according to claim 7, wherein when a 300 μm×300 μm square region is put on the outer surface of the developing roller so that one side of the square region is parallel to a direction along the mandrel of the developing roller, a proportion of a total area of the first regions in an area of the square region is 10 to 60%.

11. The developing roller according to claim 7, having protrusions in the outer surface, wherein the protrusions are constituted by each of the first regions.

12. A process cartridge which is configured to be attachable to and detachable from a main body of an electrophotographic image forming apparatus and comprises at least a developing roller, the developing roller comprising:

an electro-conductive mandrel; and an electro-conductive layer on the mandrel, the electro-conductive layer having a crown shape in which an outer diameter of a central portion in a direction along the mandrel is larger than outer diameters of both end portions in the direction along the mandrel, and an outer surface of the developing roller including electrically insulating first regions and a second region whose electro-conductivity is higher than that of the second regions, each of the first regions being adjacent to the second region, wherein in the direction along the mandrel, a proportion of an area of the first regions in at least one end part of the developing roller is larger than a proportion of an area of the first regions in the central part of the developing roller.

* * * * *